US009141014B2

(12) United States Patent
Okubo et al.

(10) Patent No.: US 9,141,014 B2
(45) Date of Patent: Sep. 22, 2015

(54) TONER FOR DEVELOPING ELECTROSTATIC CHARGE IMAGE

(75) Inventors: Masaki Okubo, Ibaraki (JP); Tatsuji Orita, Tokyo (JP); Hideyuki Otsuka, Fukushima (JP); Kenichi Sato, Fukushima (JP); Kanae Hiraishi, Ibaraki (JP)

(73) Assignee: HODOGAYA CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 14/005,029

(22) PCT Filed: Mar. 27, 2012

(86) PCT No.: PCT/JP2012/057995

§ 371 (c)(1),
(2), (4) Date: Sep. 13, 2013

(87) PCT Pub. No.: WO2012/133449

PCT Pub. Date: Oct. 4, 2012

(65) Prior Publication Data

US 2014/0004459 A1 Jan. 2, 2014

(30) Foreign Application Priority Data

Mar. 29, 2011 (JP) ..... 2011-071573

(51) Int. Cl.

| | |
|---|---|
| ***G03G 9/00*** | (2006.01) |
| ***G03G 9/097*** | (2006.01) |
| ***G03G 9/087*** | (2006.01) |
| ***G03G 9/09*** | (2006.01) |

(52) U.S. Cl.

CPC ..... *G03G 9/09775* (2013.01); *G03G 9/08782* (2013.01); *G03G 9/091* (2013.01); *G03G 9/09741* (2013.01); *G03G 9/09783* (2013.01)

(58) Field of Classification Search

CPC ..... G03G 9/08797; G03G 9/08755; G03G 9/08719; G03G 9/08782; G03G 9/08704

USPC ..... 430/108.1, 108.4, 108.8

See application file for complete search history.

(56) References Cited

U.S. PATENT DOCUMENTS

| | | | | |
|---|---|---|---|---|
| 4,206,064 | A | 6/1980 | Kiuchi et al. | |
| 4,338,390 | A | 7/1982 | Lu | |
| 4,403,027 | A | 9/1983 | Ishikawa et al. | |
| 4,673,631 | A | 6/1987 | Fukumoto et al. | |
| 4,767,688 | A | 8/1988 | Hashimoto et al. | |
| RE32,883 | E | 3/1989 | Lu | |
| 5,049,467 | A | 9/1991 | Yamanaka | |
| 5,439,770 | A | 8/1995 | Taya et al. | |
| 5,483,327 | A | 1/1996 | Taya et al. | |
| 6,110,634 | A | 8/2000 | Sawano et al. | |
| 6,218,065 | B1 | 4/2001 | Tanikawa et al. | |
| 2001/0026898 | A1* | 10/2001 | Tomita | 430/108.4 |
| 2002/0055050 | A1 | 5/2002 | Serizawa et al. | |
| 2004/0191660 | A1 | 9/2004 | Otsuka et al. | |
| 2005/0255397 | A1 | 11/2005 | Yamamoto et al. | |
| 2006/0024601 | A1 | 2/2006 | Ogawa et al. | |
| 2007/0020547 | A1 | 1/2007 | Okubo et al. | |
| 2009/0042120 | A1 | 2/2009 | Yasumura et al. | |
| 2009/0239169 | A1 | 9/2009 | Yasumura et al. | |
| 2012/0315576 | A1 | 12/2012 | Yasumura et al. | |

FOREIGN PATENT DOCUMENTS

| | | |
|---|---|---|
| JP | 55-42752 | 11/1980 |
| JP | 57-111541 | 7/1982 |
| JP | 57-119364 | 7/1982 |
| JP | 60-61765 | 4/1985 |
| JP | 61-003149 | 1/1986 |
| JP | 61-141453 | 6/1986 |
| JP | 61-155464 | 7/1986 |
| JP | 62-280763 | 12/1987 |
| JP | 1-147468 | 6/1989 |
| JP | 02-240661 | 9/1990 |
| JP | 7-98519 | 4/1995 |
| JP | 2568675 | 10/1996 |
| JP | 11-237767 | 8/1999 |
| JP | 2001-163764 | 6/2001 |
| JP | 2003-295522 | 10/2003 |
| JP | 2004-86224 | 3/2004 |
| JP | 2005-062554 | 3/2005 |
| JP | 2005-264157 | 9/2005 |
| JP | 2005-292823 | 10/2005 |
| JP | 2006-39221 | 2/2006 |
| JP | 2010-243693 | 10/2010 |
| WO | 99/28792 | 6/1999 |
| WO | 2005/095523 | 10/2005 |
| WO | 2007/119797 | 10/2007 |
| WO | 2011/105334 | 9/2011 |

OTHER PUBLICATIONS

English language translation of JP 02-240661, Sep. 25, 1990.*
English language translation of JP 60-061765, Apr. 9, 1985.*
International Search Report issued in PCT/JP2012057995 on Jun. 19, 2012.
Search report from E.P.O. in EP 12764384.9, mail date is Aug. 4, 2014.

* cited by examiner

*Primary Examiner* — Hoa V Le
(74) *Attorney, Agent, or Firm* — Greenblum & Bernstein, P.L.C.

(57) ABSTRACT

The present invention is a toner for developing electrostatic charge image containing a wax derived from a plant cholesterol, an electric charge-controlling agent, a coloring agent and a binding resin. The toner is suited for use in the electromagnetic induction-heated fixing system which is capable of heating the heating member up to a predetermined fixing temperature in a short period of time, makes it possible to maintain images free of irregular luster or fouling for extended periods of time and is, further, suited for being fixed at a low temperature.

8 Claims, No Drawings

TONER FOR DEVELOPING ELECTROSTATIC CHARGE IMAGE

TECHNICAL FIELD

This invention relates to a toner for developing electrostatic charge image used in an image-forming machine for developing electrostatic latent images in the field of electrophotography and electrostatic recording.

BACKGROUND ART

In an image-forming processing based on the electrophotographic system, the electrostatic latent images are formed on an inorganic photosensitive material such as selenium, selenium alloy, cadmium sulfide or amorphous silicon or on an organic photosensitive material formed by using a charge-generating agent and a charge-transporting agent. The thus formed electrostatic latent images are then developed with a toner, and the toner images formed on the photosensitive material are transferred onto a transfer sheet such as paper or plastic film, and are fixed thereon so as to obtain visible images.

The photosensitive material is positively charged or is negatively charged depending on its constitution. A toner that is electrically charged to a polarity opposite to that of the photosensitive material is used for the normal developing in which the photosensitive material that is electrically charged on the whole surface thereof is exposed to light, and the toner image is formed on the portions that have not been irradiated with light. On the other hand, a toner that is electrically charged to the same polarity as that of the photosensitive material is used for the reversal developing in which the photosensitive material is exposed to light, and the toner images are formed on the portions irradiated with light.

The toner is constituted by using a binder resin, a coloring agent, a wax and, as required, any other additives. Specifically, a charge control agent is, usually, added to impart desired charging properties (speed of charge, level of charge, stability in the charge, etc.), aging stability, and environmental stability. Addition of the charge control agent greatly improves the properties of the toner.

As the known charge control agents that can be positively charged upon friction, there can be exemplified Nigrosine dye, azine dye, copper phthalocyanine pigment, quaternary ammonium salt and a polymer having a quaternary ammonium salt on the side chain thereof. Further, as the charge control agents that can be negatively charged upon friction, there have been known a metal complex of monoazo dye, metal complexes of salicylic acid, naphthoic acid and dicarboxylic acid, copper phthalocyanine pigment, and resin containing acid components.

It is expected that there will be an increase in the demand for the colored toners. The charge control agents used for the colored toners must have a light color or no color so will not to affect the hue of the images. As the charge control agents, there can be exemplified metal complex compounds of hydroxybenzoic acid derivatives (e.g., see patent document 1), metal salt compounds of aromatic dicarboxylic acid (see patent document 2), metal complex compounds of anthranilic acid derivatives (see patent document 3), organoboron compounds (see patent document 4), biphenol compounds (see patent document 5), calix(n)arene compounds (see patent document 6), and cyclic phenol sulfides (see patent document 7), which are for use with the negatively charging toners. As the charge control agents for use with the positively charging toners, there can be exemplified quaternary ammonium salt compounds (see patent document 8).

As for the method of fixing toner images on the transfer sheet, the most widely used method may be the one based on the heat-melting. The heat-melting method can be roughly divided into the one of the contact type and the one of the non-contact type. Specifically, the heated roll fixing system of the contact type has a good heat efficiency and is capable of executing high-speed fixing, and has now been widely used in the copiers and printers for business use. However, the heated roll fixing system is accompanied by a problem in that a long time (stand-by time) is required for heating the roll up to a predetermined fixing temperature. As a means for solving this problem, an induction heating system was proposed and has now been put to practical use in some fields.

A representative example of the induction heating system is an electromagnetic induction heating system. The electromagnetic induction heating system, usually, uses an endless heating belt as the heating member in addition to using a heating roll. The heating belt uses a thin heat-resistant resin as a base layer, has a heat capacity smaller than that of the heating roll, and can be heated in a period of time shorter than that for the heating roll. In order to prevent the shading in the luster of image caused by a temperature difference, there has been proposed a method of preventing the occurrence of temperature difference by exchanging heat by bringing a metal roll into contact with the circumferential surface of the pushing roll that is installed facing the heating belt (see patent document 9).

PRIOR ART DOCUMENTS

Patent Documents

Patent document 1: JP-B-55-042752
Patent document 2: JP-A-57-111541
Patent document 3: JP-A-61-141453
Patent document 4: U.S. Pat. No. 4,767,688
Patent document 5: JP-A-61-003149
Patent document 6: Japanese Patent No. 2568675
Patent document 7: JP-A-2003-295522
Patent document 8: JP-A-57-119364
Patent document 9: JP-A-2005-062554

OUTLINE OF THE INVENTION

Problems that the Invention is to Solve

It is an object of the present invention to provide a toner for developing electrostatic charge image, which is capable of forming a fixed image free of shading in the luster and of fouling for extended periods of time, and is suited for attaining the fixing at low temperatures.

Another object of the present invention is to provide a toner for developing electrostatic charge image, which can be electrically charged to a sufficient degree by friction, shows a quick rise in the electric charge and excels in stably maintaining the electric charge after aging and in environmentally remaining stabile, and which composes a very safe electric charge control agent and is free from the problem in regard to regulations concerning the waste materials.

Means for Solving the Problems

According to the present invention, there is provided a toner for developing electrostatic charge image containing a wax derived from a plant sterol, a coloring agent and a binder resin.

In the toner for developing electrostatic charge image of the invention, it is desired that:

1. The plant sterol is a phytosterol;
2. The wax is the one that is obtained by a reaction of the plant sterol with a higher fatty acid; and
3. A charge control agent is, further, contained.

It is, further, desired that the charge control agent is an iron complex compound (hereinafter called iron complex compound α) represented by the following general formula (1), a zirconium compound represented by the following general formula (2), an iron complex compound (hereinafter called iron complex compound β) represented by the following general formula (3), a cyclic phenol sulfide represented by the following general formula (4), or a rhodanine compound represented by the following general formula (5).

Iron Complex Compound α:

The iron complex compound α is represented by the following general formula (1),

[Chemical 1]

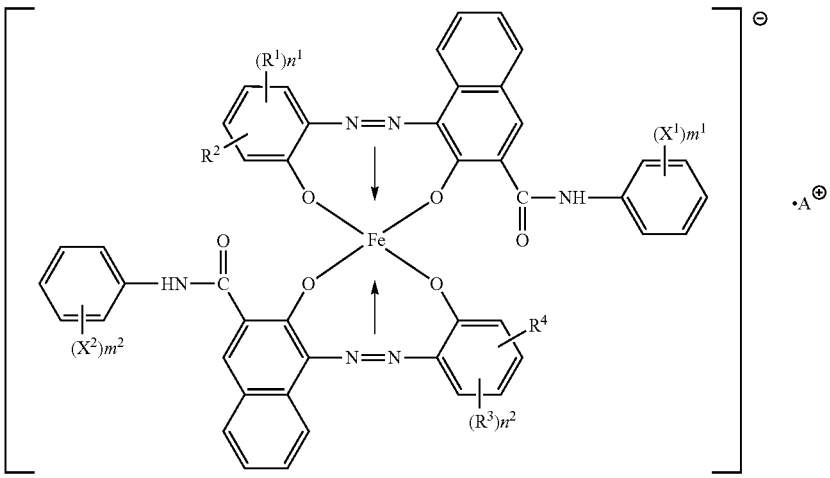

(1)

wherein, $X^1$ and $X^2$ may be the same or different, and are fluorine atoms, chlorine atoms, bromine atoms, iodine atoms, nitro groups, alkyl groups having 1 to 4 carbon atoms, or alkyloxy groups having 1 to 4 carbon atoms;

$m^1$ and $m^2$ are integers of 0 to 3;

$R^1$ and $R^3$ may be the same or different, and are fluorine atoms, chlorine atoms, bromine atoms, iodine atoms, alkyl groups having 1 to 18 carbon atoms, alkyloxy groups having 1 to 18 carbon atoms, alkenyl groups having 2 to 6 carbon atoms, sulfonamide groups, sulfonalkyl groups having 1 to 18 carbon atoms, sulfonic acid groups, carboxyl groups, carboxy ester groups, hydroxyl groups, acetylamino groups or benzoylamino groups, $n^1$ and $n^2$ are integers of 0 to 3, $R^2$ and $R^4$ are hydrogen atoms or nitro groups, $A^+$ is a hydrogen ion, sodium ion, potassium ion, ammonium ion or alkylammonium ion, and when $X^1$, $X^2$, $R^1$ or $R^3$ is present in plural numbers on the same benzene ring, the pluralities of $X^1$, $X^2$, $R^1$ or $R^3$ may be the same or different respectively.

Zirconium Compound:

The zirconium compound is represented by the following general formula (2).

[Chemical 2]

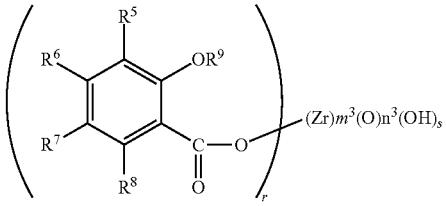

(2)

wherein, $R^5$, $R^6$, $R^7$ and $R^8$ may be the same or different, and are hydrogen atoms, fluorine atoms, chlorine atoms, bromine atoms, iodine atoms, hydroxyl groups, carboxyl groups, nitro groups, nitroso groups, cyano groups, alkyl groups having 1 to 6 carbon atoms, cycloalkyl groups having 5 or 6 carbon atoms, alkenyl groups having 2 to 6 carbon atoms, alkyloxy groups having 1 to 6 carbon atoms, cycloalkyloxy groups having 5 or 6 carbon atoms, aromatic hydrocarbon groups, heterocyclic groups, condensed polycyclic aromatic groups, aryloxy groups or amino groups, $R^5$ and $R^6$, $R^6$ and $R^7$, or $R^7$ and $R^8$ may be bonded together to form a ring, $R^9$ is a hydrogen atom or an alkyl group having 1 to 6 carbon atoms, $m^3$ is an integer of 1 to 20, $n^3$ is an integer of 0 to 20, r is an integer of 1 to 20, and s is an integer of 0 to 20.

Iron Complex Compound β:

The ion complex compound β is represented by the following general formula (3),

[Chemical 3]

(3)

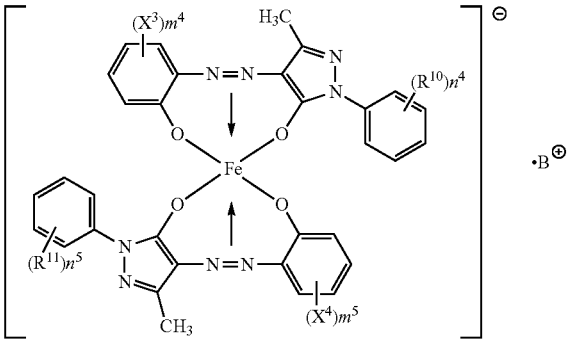

wherein, $X^3$ and $X^4$ may be the same or different, and are fluorine atoms, chlorine atoms, bromine atoms, iodine atoms or alkyl groups having 1 to 8 carbon atoms;

$m^4$ and $m^5$ are integers of 0 to 4;

$R^{10}$ and $R^{11}$ may be the same or different, and are fluorine atoms, chlorine atoms, bromine atoms, iodine atoms, alkyl groups having 1 to 8 carbon atoms, or alkyloxy groups having 1 to 8 carbon atoms;

$n^4$ and $n^5$ are integers of 0 to 5, $B^+$ is a hydrogen ion, sodium ion, potassium ion, ammonium ion or alkylammonium ion, and when $X^3$, $X^4$, $R^{10}$ or $R^{11}$ is present in plural numbers on the same benzene ring, the pluralities of $X^3$, $X^4$, $R^{10}$ or $R^{11}$ may be the same or different respectively.

Cyclic Phenol Sulfide:

The cyclic phenol sulfide is represented by the following general formula (4),

[Chemical 4]

(4)

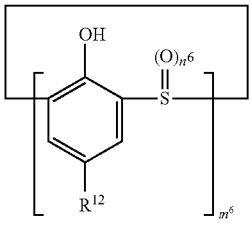

wherein, $R^{12}$ is an alkyl group having 1 to 8 carbon atoms, $m^6$ is an integer of 4 to 9, and $n^6$ is 0, 1 or 2.

Rhodanine Compound:

The rhodanine compound is represented by the following formula (5),

[Chemical 5]

(5)

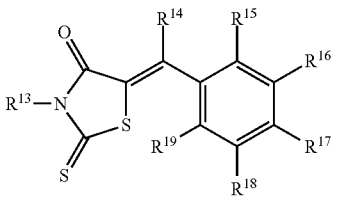

wherein, $R^{13}$ is a hydrogen atom, an alkyl group having 1 to 8 carbon atoms, a cycloalkyl group having 5 to 10 carbon atoms, an aromatic hydrocarbon group, a heterocyclic group or a condensed polycyclic aromatic group, $R^{14}$ is a hydrogen atom, an alkyl group having 1 to 8 carbon atoms, a cycloalkyl group having 5 to 10 carbon atoms, an alkenyl group having 2 to 6 carbon atoms, an alkyloxy group having 1 to 8 carbon atoms, a cycloalkyloxy group having 5 to 10 carbon atoms, an aromatic hydrocarbon group, a heterocyclic group, a condensed polycyclic aromatic group or an aryloxy group; and $R^{15}$ to $R^{19}$ may be the same or different, and are hydrogen atoms, deuterium atoms, fluorine atoms, chlorine atoms, hydroxyl groups, alkyl groups having 1 to 8 carbon atoms, cycloalkyl groups having 5 to 10 carbon atoms, alkenyl groups having 2 to 6 carbon atoms, alkyloxy groups having 1 to 8 carbon atoms, cycloalkyloxy groups having 5 to 10 carbon atoms, aromatic hydrocarbon groups, heterocyclic groups, condensed polycyclic aromatic groups or aryloxy groups, which may be bonded to each other to form a ring.

Effects of the Invention

The toner for developing electrostatic charge image of the present invention makes it possible to obtain a fixed image free of shading in the luster and of fouling for extended periods of time and is, further, suited for attaining the fixing at low temperatures.

Specifically, the compounds represented by the above-mentioned general formulas (1) to (5) are free from the problems in regard to the regulations concerning the waste materials, and serve as very safe negatively charging electric charge control agents. The toner for developing electrostatic charge image of the invention blended with the above charge control agent can be frictionally charged to a sufficient degree, shows a quick rise in the electric charge, excels in stably maintaining the electric charge after aging and in the environmental stability, and is also suited for use in a fixing system based on the electromagnetic induction heating which is capable of heating the heating members in short periods of time.

MODE FOR CARRYING OUT THE INVENTION

The toner for developing electrostatic charge image according to the present invention contains at least a binder resin, a coloring agent and a wax derived from a plant sterol (hereinafter often called plant sterol wax).

(Wax)

The plant sterol wax used for the toner of the present invention can be produced from the plant sterol and an acid such as fatty acid according to a known method, i.e., can be synthesized by the esterification reaction of the sterol with the fatty acid (see The fourth series of Experimental Chemistry 7, pp. 43-83, Japan Chemical Society, Maruzen Co. (1992)).

It is desired that the plant sterol wax used in the present invention has a melting point of 50 to 140° C., specifically, 70 to 120° C. and, most preferably, 70 to 90° C. from the standpoint of imparting fixing property and offset resistance to a suitable degree. If the above temperature is lower than the above range, the anti-blocking resistance tends to decrease and if the above temperature is higher than the above range, the offset resistance is little exhibited.

In the present invention, the melting point of the wax stands for a peak-top temperature of maximum peak in the endothermic peak of the wax measured by using the DSC.

The measurement of the wax or the toner by the DSC, in general, uses a high precision differential scanning calorimeter of the type of the internal heat input compensation, and the measurement is taken in compliance with the ASTM D3418-82. The DSC curve used for calculating the melting point is drawn by elevating the temperature at a rate of 10° C./min after the hysteresis has been cleaned up by once raising and lowering the temperature.

As the plant sterol which is the starting material of the plant sterol wax, there can be used a known phytosterol and, desirably, a β-cytosterol, a campesterol, a stigmasterol or a brassicasterol.

As the fatty acid to be reacted with the plant sterol, though there is no specific limitation, there can be preferably used a fatty acid having 8 to 30 carbon atoms, specifically, a saturated fatty acid having 8 to 30 carbon atom, and most specifically, a saturated fatty acid having 8 to 20 carbon atoms, such as caprylic acid, capric acid, lauric acid, myristic acid, palmitic acid, stearic acid and arachidic acid from the standpoint of obtaining the plant sterol wax having the melting point as described above.

The above plant sterol and the fatty acid can be used in a single kind or in a combination of two or more kinds, respectively. For instance, the wax may be a mixture of the plant sterol waxes obtained by using in a plurality of kinds either the plant sterols or the fatty acids.

In the toner of the present invention, the content of the plant sterol wax is, preferably, 0.2 to 20 parts by mass and, more preferably, 0.5 to 10 parts by mass per 100 parts by mass of the binder resin.

In the toner of the invention, further, it is allowed to use any other known waxes in combination with the above plant sterol wax to further enhance the plasticizing action of the wax (to improve fixing property) and to enhance the parting action (to improve offset resistance).

Described below are the examples of the other waxes.

Aliphatic hydrocarbon waxes such as low molecular polyethylene, low molecular polypropylene, polyolefin wax, microcrystalline wax, paraffin wax and sasol wax;

Oxide of an aliphatic hydrocarbon wax such as polyethylene oxide wax, or a block copolymer thereof;

Plant waxes such as candelilla wax, carnauba wax, Japan wax and jojoba wax;

Animal waxes such as bees wax, lanolin and whale wax;

Mineral waxes such as ozocerite, ceresine and petrolatum;

Waxes comprising chiefly fatty acid esters, such as montanic ester wax and castor wax;

Those obtained by partly or wholly deoxidizing the fatty acid ester such as acid carnauba wax.

In addition to the above, there can be used the following compounds and polymers as other waxes together with the plant sterol waxes.

Saturated straight-chain fatty acids such as palmitic acid, stearic acid, montanic acid and other straight-chain alkylcarboxylic acids having a straight-chain alkyl group;

Unsaturated fatty acids such as brassidic acid, eleostearic acid and parinaric acid;

Saturated alcohols such as stearyl alcohol, eicosyl alcohol, behenyl alcohol, carnaubyl alcohol, ceryl alcohol, melissyl alcohol and long-chain alkyl alcohol;

Polyhydric alcohols such as sorbitol and the like;

Fatty acid amides such as linoleic acid amide, olefin acid amide and lauric acid amide;

Saturated fatty acid bisamides such as methylenebiscapric acid amide, ethylenebislauric acid amide, and hexamethylenebisstearic acid amide;

Unsaturated fatty acid amides such as ethylenebisoleic acid amide, hexamethylenebisoleic acid amide, N,N'-dioleyladipic acid amide, and N,N'-dioleylsebacic acid amide;

Aromatic bisamides such as m-xylenebisstearic acid amide and N,N'-distearylisophthalic acid amide;

Fatty acid metal salts such as calcium stearate, calcium laurate, zinc stearate and magnesium stearate;

Modified waxes obtained by grafting the aliphatic hydrocarbon wax with a vinyl monomer such as styrene or acrylate;

Partly esterified compounds of a fatty acid such as behenic acid monoglyceride and a polyhydric alcohol; and Methyl ester compounds having a hydroxyl group obtained by hydrogenating plant oils and fats.

In general, the wax of a low melting point exhibits a high plasticizing action and the wax of a high melting point exhibits a high parting action though it may differ depending upon the chemical structure. Among the above-mentioned waxes, therefore, those having melting points different from that of the plant sterol wax by a range of 10 to 100° C. can be used in one kind or in a combination of two or more kinds depending on the object. However, the amount of use thereof should be so small that will not impair the luster of the toner brought about by the plant sterol wax.

Through the press-sweating method, solvent method, recrystallization method, vacuum distillation method, supercritical gas extraction method or solution crystallization method, further, the above-mentioned various waxes can be sharpened for their molecular weight distribution, can be got rid of impurities such as low molecular solid fatty acids, low molecular solid alcohols, low molecular solid compounds and the like, and can be used as toner additives.

(Charge Control Agent)

To increase the frictional charging property, the toner of the invention is suitably blended with a charge control agent that can be positively charged upon friction or a charge control agent that can be negatively charged upon friction.

These charge control agents can be used in amounts that differ depending on their kinds but are, usually, used in amounts in a range of 0.05 to 20 parts by mass and, specifically, 0.1 to 10 parts by mass per 100 parts by mass of the binder resin.

As the charge control agent that can be positively charged by friction, there can be exemplified Nigrosine dye, azine dye, copper phthalocyanine pigment, quaternary ammonium salt and a polymer having a quaternary ammonium salt on a side chain thereof. Among them, the quaternary ammonium salt compound is preferred. These charge control agents that can be positively charged upon friction are suitably used in one kind or in a combination of two or more kinds.

As the charge control agent that can be negatively charged by friction, there can be exemplified metal complex of monoazo dye, metal complex compound of hydroxybenzoic acid derivative, aromatic metal dicarboxylate compound, metal complex compound of anthranilic acid derivative, organoboron compound, biphenol compound, calix(n)arene compound, cyclic phenol sulfate, rhodanine compound, thiazolidinedion derivative, barbituric acid derivative, hydantoin derivative, isophthalic acid derivative, copper phthalocyanine pigment and resin containing acid components. Among them, it is desired to use metal complex of monoazo dye, metal complex compound of hydroxybenzoic acid derivative, cyclic phenol sulfide, rhodanine compound, thiazolidinedion derivative, barbituric acid derivative, hydantoin derivative and isophthalic acid derivative.

Among them, in particular, the iron complex compound α, zirconium compound, iron complex compound β, cyclic phenol sulfide and rhodanine compound having the structures described below are best suited for exhibiting negatively charging property upon friction to an excellent degree in a dispersion system that contains the above plant sterol wax.

Iron Complex Compound α:

As described earlier, the iron complex compound α is represented by the following general formula (1),

[Chemical 6]

(1)

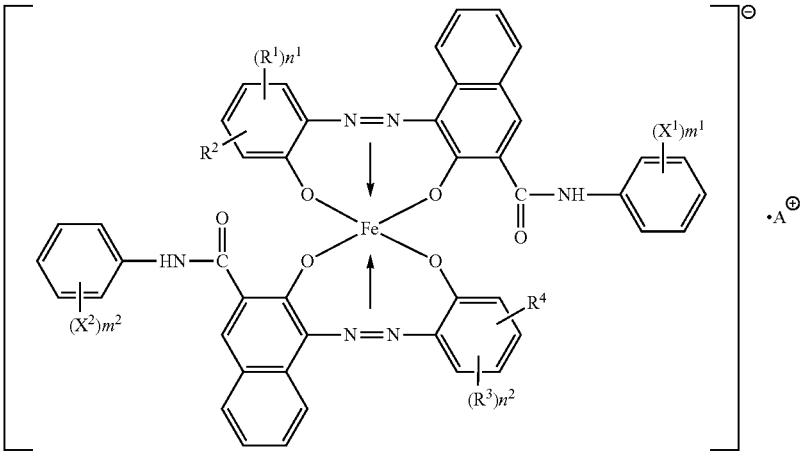

In the general formula (1), $m^1$ is a number of the groups $X^1$ and $m^2$ is a number of the groups $X^2$, $m^1$ and $m^2$ being integers of 0 to 3, respectively.

Further, $n^1$ is a number of the groups $R^1$ and $n^2$ is a number of the groups $R^3$, $n^1$ and $n^2$ being integers of 0 to 3, respectively.

<$X^1$, $X^2$>

In the general formula (1), $X^1$ and $X^2$ may be the same or different, and are fluorine atoms, chlorine atoms, bromine atoms, iodine atoms, nitro groups, alkyl groups having 1 to 4 carbon atoms, or alkyloxy groups having 1 to 4 carbon atoms.

The alkyl group having 1 to 4 carbon atoms may be of a straight chain or branched, and can be methyl group, ethyl group, n-propyl group, isopropyl group, n-butyl group, isobutyl group or tert-butyl group.

The alkyloxy group having 1 to 4 carbon atoms may be of a straight chain or branched, and can be methyloxy group, ethyloxy group, n-propyloxy group, isopropyloxy group, n-butyloxy group or tert-butyloxy group.

<$R^1$, $R^3$>

$R^1$ and $R^3$ may be the same or different, and are fluorine atoms, chlorine atoms, bromine atoms, iodine atoms, alkyl groups having 1 to 18 carbon atoms, alkyloxy groups having 1 to 18 carbon atoms, alkenyl groups having 2 to 6 carbon atoms, sulfonamide groups, sulfonalkyl groups having 1 to 18 carbon atoms, sulfonic acid groups, carboxyl groups, carboxy ester groups, hydroxyl groups, acetylamino groups or benzoylamino groups.

The alkyl group having 1 to 18 carbon atoms may be of a straight chain or branched, and can be methyl group, ethyl group, n-propyl group, isopropyl group, n-butyl group, isobutyl group, tert-butyl group, n-pentyl group, isopentyl group, neopentyl group, n-hexyl group, n-heptyl group, isoheptyl group, n-octyl group, isooctyl group, n-nonyl group, n-decyl group, n-dodecyl group, n-hexadecyl group or n-octadecyl group.

The alkyloxy group having 1 to 18 carbon atoms may be either of a straight chain or branched, and can be methyloxy group, ethyloxy group, n-propyloxy group, isopropyloxy group, n-butyloxy group, tert-butyloxy group, n-pentyloxy group, n-hexyloxy group, n-heptyloxy group, isoheptyloxy group, n-octyloxy group, n-nonyloxy group, n-decyloxy group, n-dodecyloxy group, n-hexadecyloxy group or n-octadecyloxy group.

The alkenyl group having 2 to 6 carbon atoms may be either of a straight chain or branched, and can be vinyl group, allyl group, isopropenyl group or 2-butenyl group.

The alkyl group having 1 to 18 carbon atoms possessed by the sulfonalkyl group may be either of a straight chain or branched, and can be the same ones as those exemplified for the above alkyl group having 1 to 18 carbon atoms.

<$R^2$, $R^4$>

$R^2$ and $R^4$ are hydrogen atoms or nitro groups.

<$A^+$>

In the above formula (1), $A^+$ is hydrogen ion, sodium ion, potassium ion, ammonium ion or alkylammonium ion, and may be of a single kind or a combination of two or more kinds.

The alkylammonium ion is an ion formed as the hydrogen atom bonded to the nitrogen atom is substituted with 1 to 4 alkyl groups, the alkyl groups being the same or different each other. As such alkyl groups, there can be exemplified the same alkyl groups as those alkyl groups having 1 to 18 carbon atoms represented by $R^1$ and $R^3$.

Zirconium Compound:

As described earlier, the zirconium compound is represented by the following general formula (2),

[Chemical 7]

(2)

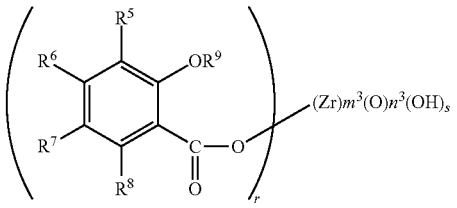

In the general formula (2), $m^3$ represents a number of zirconium atoms and is an integer of 1 to 20, $n^3$ represents a number of oxygen atoms and is an integer of 0 to 20, s represents a number of hydroxyl groups and is an integer of 0 to 20, and r represents a number of carboxyl residues and is an integer of 1 to 20.

<$R^5$ to $R^8$>

In the general formula (2), $R^5$ to $R^8$ may be the same or different, and are hydrogen atoms, fluorine atoms, chlorine atoms, bromine atoms, iodine atoms, hydroxyl groups, carboxyl groups, nitro groups, nitroso groups, cyano groups, alkyl groups having 1 to 6 carbon atoms, cycloalkyl groups having 5 or 6 carbon atoms, alkenyl groups having 2 to 6 carbon atoms, alkyloxy groups having 1 to 6 carbon atoms, cycloalkyloxy groups having 5 or 6 carbon atoms, aromatic hydrocarbon groups, heterocyclic groups, condensed polycyclic aromatic groups, aryloxy groups or amino groups.

The alkyl group having 1 to 6 carbon atoms may be of a straight chain or branched, and can be methyl group, ethyl group, n-propyl group, isopropyl group, n-butyl group, isobutyl group, tert-butyl group, n-pentyl group, isopentyl group, neopentyl group or n-hexyl group.

As the cycloalkyl group having 5 or 6 carbon atoms, there can be exemplified cyclopentyl group and cyclohexyl group.

The alkenyl group having 2 to 6 carbon atoms may be of a straight chain or branched, and can be vinyl group, allyl group, isopropenyl group or 2-butenyl group.

The alkyloxy group having 1 to 6 carbon atoms may be of a straight chain or branched, and can be methyloxy group, ethyloxy group, n-propyloxy group, isopropyloxy group, n-butyloxy group, tert-butyloxy group, n-pentyloxy group or n-hexyloxy group.

As the cycloalkyloxy group having 5 or 6 carbon atoms, there can be exemplified cyclopentyloxy group and cyclohexyloxy group.

The groups represented by $R^5$ to $R^8$ may be bonded together to form a ring.

The above alkyl group, cycloalkyl group, alkenyl group, alkyloxy group and cycloalkyloxy group may, further, have other substituents. Examples of the substituents are as described below.

Deuterium atom;

Trifluoromethyl group;

Cyano group;

Nitro group;

Halogen atoms such as fluorine atom, chlorine atom, bromine atom and iodine atom;

Alkyl groups having 1 to 8 carbon atoms, such as methyl group, ethyl group, n-propyl group, isopropyl group, n-butyl group, isobutyl group, tert-butyl group, n-pentyl group, isopentyl group, neopentyl group, n-hexyl group, n-heptyl group, isoheptyl group, n-octyl group and isooctyl group;

Alkoxy groups having 1 to 8 carbon atoms, such as methoxy group, ethoxy group and propyloxy group;

Alkenyl groups such as allyl group and the like;

Aralkyl groups such as benzyl group, naphthylmethyl group and phenetyl group;

Aryloxy groups such as phenoxy group and tolyloxy group;

Arylalkoxy groups such as benzyloxy group and phenetyloxy group;

Aromatic hydrocarbon groups or condensed polycyclic aromatic groups, such as phenyl group, biphenylyl group, terphenylyl group, naphthyl group, anthracenyl group, phenanthryl group, fluorenyl group, indenyl group, pyrenyl group, perylenyl group, fluoranthenyl group and triphenylenyl group;

Heterocyclic groups such as pyridyl group, furanyl group, pyranyl group, thienyl group, furyl group, pyrolyl group, pyrrolidinyl group, imidazolyl group, imidazolinyl group, imidazolidinyl group, pyrazolyl group, pyrazolinyl group, pyrazolidinyl group, pyridazinyl group, pyrazinyl group, piperidinyl group, piperadinyl group, thioranyl group, thianyl group, quinolyl group, isoquinolyl group, benzofuranyl group, benzothienyl group, indolyl group, carbazolyl group, benzoxazolyl group, benzothiazolyl group, quinoxalyl group, benzoimidazolyl group, pyrazolyl group, dibenzofuranyl group, dibenzothienyl group and carbolynyl group;

Arylvinyl groups such as stylyl group and naphthylvinyl group;

Acyl groups such as acetyl group and benzoyl group;

Dialkylamino groups such as dimethylamino group and diethylamino group;

Disubstituted amino groups substituted with aromatic hydrocarbon group or condensed polycyclic aromatic group, such as diphenylamino group and dinaphthylamino group;

Diaralkylamino groups such as dibenzylamino group and diphenetylamino group;

Disubstituted amino groups substituted with heterocyclic group, such as dipyridylamino group, dithienylamino group and dipiperidinylamino group;

Dialkenyl amino group such as diallylamino groups and the like; and

Disubstituted amino groups substituted with a substituent selected from alkyl group, aromatic hydrocarbon group, condensed polycyclic aromatic group, aralkyl group, heterocyclic group and alkenyl group.

The above substituents may, further, have other substituents and may be coupled to each other to form a ring.

As the aromatic hydrocarbon groups or the condensed polycyclic aromatic groups represented by $R^5$ to $R^8$, there can be exemplified phenyl group, biphenylyl group, terphenylyl group, naphthyl group, anthrily group, phenanthryl group, fluorenyl group, indenyl group, pyrenyl group, perylenyl group, fluoranthenyl group and triphenylenyl group.

As the heterocyclic groups represented by $R^5$ to $R^8$, there can be exemplified pyridyl group, furanyl group, pyranyl group, thienyl group, pyrrolidinyl group, imidazolyl group, imidazolinyl group, imidazolidinyl group, pyrazolyl group, pyrazolinyl group, pyrazolidinyl group, pyridazinyl group, pyrazinyl group, piperidinyl group, piperazinyl group, thioranyl group, thianyl group, quinolyl group, isoquinolyl group, benzofuranyl group, benzothienyl group, indolyl group, carbazolyl group, benzoxazolyl group, benzothiazolyl group, quinoxalyl group, benzoimidazolyl group, pyrazolyl group, dibenzofuranyl group, dibenzothienyl group and carbolinyl group.

As the aryloxy groups represented by $R^5$ to $R^8$, there can be exemplified phenoxy group, tolyloxy group, biphenylyloxy group, terphenylyloxy group, naphthyloxy group, anthryloxy group, phenanthryloxy group, fluorenyloxy group, indenyloxy group, pyrenyloxy group and perylenyloxy group.

The above groups may be bonded together to form a ring.

The above aromatic hydrocarbon group, heterocyclic group, condensed polycyclic aromatic group and aryloxy group may, further, have other substituents. As the substituents, there can be exemplified the following substitutents in addition to the substitutents that are, further, possessed by the alkyl group, cycloalkyl group, alkenyl group, alkyloxy group and cycloalkyloxy group represented by $R^5$ to $R^8$.

Cycloalkyl groups having 5 to 10 carbon atoms, such as cyclopentyl group and cyclohexyl group;

Alkenyl groups having 2 to 6 carbon atoms, such as vinyl group, 2-butenyl group and 1-hexenyl group;

Cycloalkyloxy groups having 5 to 10 carbon atoms, such as cyclopentyloxy group and cyclohexyloxy group; and Aryloxy groups such as biphenylyloxy group, terphenylyloxy group, naphthyloxy group, anthryloxy group, phenanthryloxy group, fluorenyloxy group, indenyloxy group, pyrenyloxy group and perylenyloxy group.

These groups may be bonded together to form a ring.

The amino groups represented by $R^5$ to $R^8$ may, further, have other substituents. As the amino groups having substituents, there can be exemplified the following groups.

Dialkylamino groups such as dimethylamino group and diethylamino group;

Disubstituted amino groups substituted with aromatic hydrocarbon groups or condensed polycyclic aromatic groups, such as diphenylamino group and dinaphthylamino group;

Diaralkylamino groups such as dibenzylamino group and diphenetylamino group;

Disubstituted amino groups substituted with heterocyclic groups, such as dipyridylamino group, dithienylamino group and dipiperidinylamino group;

Dialkenylamino groups such as diallylamino group and the like groups; and

Disubstituted amino groups substituted with substituents selected from alkyl group, aromatic hydrocarbon group, condensed polycyclic aromatic group, aralkyl group, heterocyclic group and alkenyl group.

<$R^9$>

In the above formula (2), $R^9$ represents a hydrogen atom or an alkyl group having 1 to 6 carbon atoms.

As the alkyl group having 1 to 6 carbon atoms represented by $R^9$, there can be exemplified the same groups as the alkyl groups having 1 to 6 carbon atoms represented by $R^5$ to $R^8$.

The group represented by $R^9$ may, further, have other substituents. As the substituents, there can be exemplified the same substituents as the substituents which are, further, possessed by the alkyl group, cycloalkyl group, alkenyl group, alkyloxy group and cycloalkyloxy group represented by $R^5$ to $R^8$. These substituents may, further, have other substituents.

Iron Complex Compound β:

As described earlier, the iron complex compound β is represented by the following general formula (3),

<$R^{10}$, $R^{11}$>

In the above formula (3), $R^{10}$ and $R^{11}$ may be the same or different, and are fluorine atoms, chlorine atoms, bromine atoms, iodine atoms, alkyl groups having 1 to 8 carbon atoms or alkyloxy groups having 1 to 8 carbon atoms.

As the alkyl group having 1 to 8 carbon atoms, there can be exemplified the same groups as the alkyl groups having 1 to 8 carbon atoms represented by $X^3$ and $X^4$.

The alkyloxy group having 1 to 8 carbon atoms may be of a straight chain or branched, and can be methyloxy group, ethyloxy group, n-propyloxy group, isopropyloxy group, n-butyloxy group, tert-butyloxy group, n-pentyloxy group, n-hexyloxy group, n-heptyloxy group, isoheptyloxy group, n-octyloxy group or isooctyloxy group.

<$B^+$>

In the above formula (3), $B^+$ is hydrogen ion, sodium ion, potassium ion, ammonium ion or alkylammonium ion, which may be used in one kind or in a combination of two or more kinds.

The alkylammonium ion is an ammonium ion in which a hydrogen atom bonded to a nitrogen atom is substituted with 1 to 4 alkyl groups, the alkyl groups being the same or different. As the alkyl group, there can be exemplified the same groups as the alkyl groups having 1 to 18 carbon atoms represented by $R^1$ and $R^3$ in the above formula (1).

Cyclic Phenol Sulfide:

As described earlier, the cyclic phenol sulfide is represented by the following general formula (4),

[Chemical 8]

(3)

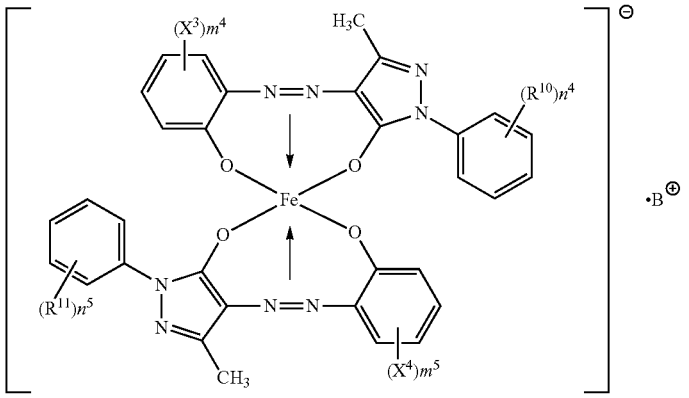

In the general formula (3), $m^4$ represents a number of the groups $X^3$ and $m^5$ represents a number of the groups $X^4$, $m^4$ and $m^5$ being integers of 0 to 4, respectively, and $n^4$ represents a number of the groups $R^{10}$ and $n^5$ represents a number of the groups $R^{11}$, $n^4$ and $n^5$ being integers of 0 to 5, respectively.

<$X^3$, $X^4$>

In the general formula (3), $X^3$ and $X^4$ may be the same or different, and are fluorine atoms, chlorine atoms, bromine atoms, iodine atoms or alkyl groups having 1 to 8 carbon atoms.

The alkyl group having 1 to 8 carbon atoms may be of a straight chain or branched, and can be methyl group, ethyl group, n-propyl group, isopropyl group, n-butyl group, isobutyl group, tert-butyl group, n-pentyl group, isopentyl group, neopentyl group, n-hexyl group, n-heptyl group, isoheptyl group, n-octyl group or isooctyl group.

[Chemical 9]

(4)

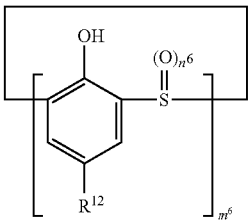

In the general formula (4), $m^6$ represents a number of basic units that constitute the ring and is an integer of 4 to 9, and $n^6$ is a number of oxygen atoms bonded to S and is 0, 1 or 2.

<$R^{12}$>

In the general formula (4), $R^{12}$ is an alkyl group having 1 to 8 carbon atoms.

As the alkyl group, there can be exemplified the same groups as the alkyl groups having 1 to 8 carbon atoms represented by $X^3$ and $X^4$ in the formula (3).

Rhodanine Compound:

As described earlier, the rhodanine compound is represented by the following general formula (5),

[Chemical 10]

(5)

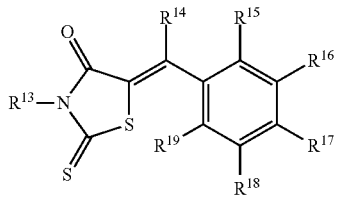

<$R^{13}$>

In the general formula (5), $R^{13}$ is hydrogen atom, alkyl group having 1 to 8 carbon atoms, cycloalkyl group having 5 to 10 carbon atoms, aromatic hydrocarbon group, heterocyclic group or condensed polycyclic aromatic group.

As the alkyl group having 1 to 8 carbon atoms, there can be exemplified the same groups as the alkyl groups having 1 to 8 carbon atoms represented by $X^3$ and $X^4$ in the formula (3).

As the cycloalkyl group having 5 to 10 carbon atoms, there can be exemplified cyclopentyl group, cyclohexyl group, 1-adamantyl group and 2-adamantyl group.

As the aromatic hydrocarbon group or the condensed polycyclic aromatic group, there can be exemplified the same groups as the aromatic hydrocarbon groups or the condensed polycyclic aromatic groups represented by $R^5$ to $R^8$ in the formula (2).

As the heterocyclic group, there can be exemplified the same groups as the heterocyclic groups represented by $R^5$ to $R^8$ in the formula (2).

The aromatic hydrocarbon group, heterocyclic group or condensed polycyclic aromatic group may, further, have other substituents. As the substituents, there can be exemplified the same groups as the substituents that are, further, possessed by the aromatic hydrocarbon groups, heterocyclic groups, condensed polycyclic aromatic groups or aryloxy groups represented by $R^5$ to $R^8$ in the formula (2). These substituents may, further, have other substituents.

<$R^{14}$ to $R^{19}$>

In the general formula (5), $R^{14}$ is hydrogen atom, alkyl group having 1 to 8 carbon atoms, cycloalkyl group having 5 to 10 carbon atoms, alkenyl group having 2 to 6 carbon atoms, alkyloxy group having 1 to 8 carbon atoms, cycloalkyloxy group having 5 to 10 carbon atoms, aromatic hydrocarbon group, heterocyclic group, condensed polycyclic aromatic group or aryloxy group.

In the general formula (5), further, $R^{15}$ to $R^{19}$ may be the same or different, and are hydrogen atoms, deuterium atoms, fluorine atoms, chlorine atoms, hydroxyl groups, alkyl groups having 1 to 8 carbon atoms, cycloalkyl groups having 5 to 10 carbon atoms, alkenyl groups having 2 to 6 carbon atoms, alkyloxy groups having 1 to 8 carbon atoms, cycloalkyloxy groups having 5 to 10 carbon atoms, aromatic hydrocarbon groups, heterocyclic groups, condensed polycyclic aromatic groups or aryloxy groups, which may be bonded together to form a ring.

As the alkyl group having 1 to 8 carbon atoms, there can be exemplified the same groups as the alkyl groups having 1 to 8 carbon atoms represented by $X^3$ and $X^4$ in the formula (3).

As the cycloalkyl group having 5 to 10 carbon atoms, there can be exemplified the same groups as the cycloalkyl groups having 5 to 10 carbon atoms represented by $R^{13}$.

The alkenyl group having 2 to 6 carbon atoms may be of a straight chain or branched, and can be vinyl group, allyl group, isopropenyl group or 2-butenyl group.

The above alkyl group, cycloalkyl group and alkenyl group may be simply bonded together to form a ring, or bonded together via oxygen atoms or sulfur atoms to form a ring.

As the alkyloxy group having 1 to 8 carbon atoms, there can be exemplified the same groups as the alkyloxy groups having 1 to 8 carbon atoms represented by $R^{10}$ and $R^{11}$ in the formula (3)

As the cycloalkyloxy group having 5 to 10 carbon atoms, there can be exemplified cyclopentyloxy group, cyclohexyloxy group, cycloheptyloxy group, cyclooctyloxy group, 1-adamantyloxy group and 2-adamantyloxy group.

The above alkyloxy group and cycloalkyloxy group may be simply bonded together to form a ring, or bonded together via an oxygen atom or a sulfur atom to form a ring.

As the aromatic hydrocarbon group or the condensed polycyclic aromatic group, there can be exemplified the same groups as the aromatic hydrocarbon groups or the condensed polycyclic aromatic groups represented by $R^5$ to $R^8$ in the formula (2).

As the heterocyclic group, there can be exemplified the same groups as the heterocyclic groups represented by $R^5$ to $R^8$ in the formula (2).

The above aromatic hydrocarbon groups, heterocyclic groups or condensed polycyclic aromatic groups may be simply bonded together to form a ring, or bonded together via oxygen atoms or sulfur atoms to form a ring.

The aromatic hydrocarbon groups, heterocyclic groups or condensed polycyclic aromatic groups may, further, have other substituents. As the substituents, there can be exemplified the same groups as the substituents which are, further, possessed by the aromatic hydrocarbon groups, heterocyclic groups, condensed polycyclic aromatic groups or aryloxy groups represented by $R^5$ to $R^8$ in the formula (2). These substituents may, further, have other substituents, and may be simply bonded together to form a ring, or bonded together via oxygen atoms or sulfur atoms to form a ring.

As the aryloxy groups represented by $R^{14}$ to $R^{19}$, there can be exemplified the same groups as the aryloxy groups represented by $R^5$ to $R^8$ in the formula (2). $R^{14}$ to $R^{19}$ may be simply bonded together or bonded together via oxygen atoms or sulfur atoms to form a ring.

The aryloxy group may, further, have other substituents. As the other substituents, there can be exemplified the groups same as the substituents which are, further, possessed by the aromatic hydrocarbon groups, heterocyclic groups, condensed polycyclic aromatic groups or aryloxy groups represented by $R^5$ to $R^8$ in the formula (2). These substituents may, further, have other substituents, and may be simply bonded together to form a ring, or bonded together via oxygen atoms or sulfur atoms to form a ring.

(Binder Resin)

As the binder resin used for the toner of the invention, there can be used any one that has been known per se. Concretely, there can be used a vinyl polymer such as of styrene monomer, acrylate monomer or methacrylate monomer, or a vinyl copolymer of two or more kinds of these monomers, as well as polyester polymer, polyol resin, phenol resin, silicone resin, polyurethane resin, polyamide resin, furane resin, epoxy resin, xylene resin, terpene resin, cumaron indene resin, polycarbonate resin and petroleum resin.

<Vinyl Polymer, Vinyl Copolymer>

Described below are examples of the styrene monomer, acrylate monomer and methacrylate monomer used for forming the vinyl polymers or the vinyl copolymers to which only, however, the invention is in no way limited.

As the styrene monomer, there can be exemplified styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene, or derivatives thereof.

As the acrylate monomer, there can be exemplified acrylic acids such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, steallyl acrylate, 2-chloroethyl acrylate and phenyl acrylate, and esters thereof.

As the methacrylate monomer, there can be exemplified methacrylic acids such as methacrylic acid, methyl methacrylate, ethyl methacrylate, propyl methacrylate, n-butylmethacrylate, isobutyl methacrylate, n-octyl methacrylate, n-dodecyl methacrylate, 2-ethylhexyl methacrylate, steallyl methacrylate, phenyl methacrylate, dimethylaminoethyl methacrylate and diethylaminoethyl methacrylate and esters thereof.

Described below are other monomers (1) to (18) used for forming the vinyl polymers or the vinyl copolymers.

(1) Monoolefins such as ethylene, propylene, butylene and isobutylene;

(2) Polyenes such as butadiene and isoprene;

(3) Vinyl halides such as vinyl chloride, vinylidene chloride, vinyl bromide and vinyl fluoride;

(4) Vinyl esters such as vinyl acetate, vinyl propionate and vinyl benzoate;

(5) Vinyl ethers such as vinyl methyl ether, vinyl ethyl ether and vinyl isobutyl ether;

(6) Vinyl ketones such as vinyl methyl ketone, vinyl hexyl ketone and methylisopropenyl ketone;

(7) N-vinyl compounds such as N-vinylpyrrole, N-vinylcarbazole, N-vinylindole and N-vinylpyrrolidone;

(8) Vinyl naphthalenes;

(9) (Meth)acrylic acid derivatives such as acrylonitrile, methacrylonitrile and acrylamide;

(10) Unsaturated dibasic acids such as maleic acid, citraconic acid, itaconic acid, alkenylsuccinic acid, fumaric acid and mesaconic acid;

(11) Unsaturated dibasic anhydrides such as maleic anhydride, citraconic anhydride, itaconic anhydride and alkenylsuccinic anhydride;

(12) Unsaturated dibasic monoesters such as maleate monomethyl ester, maleate monoethyl ester, maleate monobutyl ester, citraconic acid monomethyl ester, citraconic acid monoethyl ester, citraconic acid monobutyl ester, itaconic acid monomethyl ester, alkenylsuccinic acid monomethyl ester, fumaric acid monomethyl ester and mesaconic acid monomethyl ester;

(13) Unsaturated dibasic acid esters such as dimethylmaleic acid and dimethylfumaric acid;

(14) α,β-unsaturated acids such as crotonic acid and cinnamic acid;

(15) α,β-unsaturated acid anhydrides such as crotonic anhydride and cinnamic anhydride;

(16) Monomers having a carboxyl group such as anhydrides of the α,β-unsaturated acids and a lower fatty acid, alkenylmalonic acid, alkenylglutaric acid, alkenyladipic acid, acid anhydrides thereof, and monoeters thereof;

(17) (Meth)acrylic hydroxyalkyl esters, such as 2-hydroxyethyl acrylate, 2-hydroxyethyl methacrylate and 2-hydroxypropyl methacrylate; and

(18) Monomers having a hydroxy group, such as 4-(1-hydroxy-1-methylbutyl)styrene and 4-(1-hydroxy-1-methylhexyl)styrene.

The vinyl polymer or the vinyl copolymer may have a crosslinked structure crosslinked with a crosslinking agent having two or more vinyl groups. As the crosslinking agent, there can be exemplified those that have been known per se., such as aromatic divinyl compound, di(meth)acrylate compound bonded with an alkyl chain that includes an ether bond, di(meth)acrylate compounds bonded with an aromatic group and a chain including an ether bond, polyester type diacrylates, and polyfunctional crosslinking agent.

As the aromatic divinyl compound, there can be exemplified divinylbenzene and divinylnapthalene.

As the di(meth)acrylate compounds bonded with an alkyl chain, there can be exemplified ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth)acrylate and neopentyl glycol di(meth)acrylate.

As the di(meth)acrylate compounds bonded with the alkyl chain including an ether bond, there can be exemplified diethylene glycol di(meth)acrylate, triethylene glycol di(meth) acrylate, tetraethylene glycol di(meth)acrylate, polyethylene glycol #400 di(meth)acrylate, polyethylene glycol #600 (meth)diacrylate and dipropylene glycol di(meth)acrylate.

As the polyester type diacrylates, there can be exemplified MANDA (trade name, manufactured by NIPPON KAYAKU Co., Ltd.) and the like.

As the polyfunctional crosslinking agent, there can be exemplified pentaerythritol tri(meth)acrylate, trimethylolethane tri(meth)acrylate, trimethylolpropane tri(meth)acrylate, tetramethylolmethane tetra(meth)acrylate, oligoester (meth)acrylate, triallyl cyanulate, and triallyl trimellitate.

The crosslinking agent can be used in an amount of, preferably, 0.01 to 10 parts by mass and, particularly preferably, 0.03 to 5 parts by mass per 100 parts by mass of the monomer component that forms the vinyl polymer or the copolymer. Among these crosslinking monomers, there can be preferably used aromatic divinyl compound (specifically, divinylbenzene), and diacrylate compounds bonded with an aromatic group and a binder chain that includes an ether bond from the standpoint of fixing property to the resin for toner and offset resistance. It is desired to use these crosslinking agents in combination with the monomers that become the styrene copolymer or the styrene-acrylate copolymer.

When the styrene-acrylate resin is used as the binder resin, it is desired that a component of the styrene-acrylate resin soluble in the tetrahydrofurane (THF) has at least one peak in a region of number average molecular weights of 3,000 to 50,000 and at least one peak in a region of number average molecular weights of not less than 100,000 in the number average molecular weight distribution as measured by the gel permeation chromatography (GPC) from the standpoint of fixing property, offset property and storage property. Of the components of the styrene-acrylate resin soluble in the THF, further, it is desired that 50 to 90% of the components dissolved therein have number average molecular weights of not more than 100,000. The styrene-acrylate resin, more preferably, has a main peak in a region of number average molecular weights of 5,000 to 30,000 and, most preferably, has a main peak in a region of 5,000 to 20,000 in the number average molecular weight distribution.

The vinyl polymer such as the styrene-acrylate resin has an acid value of, desirably, from 0.1 to 100 mgKOH/g, more desirably, from 0.1 to 70 mgKOH/g and, particularly desirably, from 0.1 to 50 mgKOH/g.

<Polyester Polymer>

Described below are monomers that constitute the polyester polymer.

As the divalent alcohol component, there can be exemplified ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained by polymerizing bisphenol A with a cyclic ether such as ethylene oxide or propylene oxide.

To crosslink the polyester resin, it is desired to use an alcohol having a valence of three or more in combination therewith. As the polyhydric alcohol having a valence of three or more, there can be exemplified sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4,-butanetriol, trimethylolethane, trimethylolpropane and 1,3,5-trihydroxybenzene.

As the acid component for forming the polyester type polymer, there can be exemplified benzenedicarboxylic acids such as phthalic acid, isophthalic acid and terephthalic acid, as well as anhydrides thereof; alkyldicarboxylic acids such as succinic acid, adipic acid, sebacic acid and azelaic acid, as well as anhydrides thereof; unsaturated dibasic acids such as maleic acid, citraconic acid, itaconic acid, alkenylsuccinic acid, fumaric acid and mesaconic acid; and unsaturated dibasic acid anhydrides such as maleic anhydride, citraconic anhydride, itaconic anhydride and alkenylsuccinic anhydride. As the polyhydric carboxylic acid component having a valence of 3 or more, there can be exemplified trimellitic acid, pyromellitic acid, 2,5,7-naphthalenetricarboxylic acid, 1,2,4-naphthalenetricarboxylic acid, 1,2,4-butanetricarboxylic acid, 1,2,5-hexanetricarboxylicacid, 1,3-dicarboxy-2-methyl-2-methylenecarboxypropane, tetra(methylenecarboxy) methane, 1,2,7,8-octanetetracarboxylic acid, enpole trimer acid, anhydrides thereof, and partly lower alkylester.

When the polyester type resin is used as the binder resin, it is desired that a component of the polyester type resin soluble in the THF has at least one peak in a region of number average molecular weights of 3,000 to 50,000 in the molecular weight distribution from the standpoint of toner fixing property and offset resistance. Of the components soluble in the THF, further, it is desired that 60 to 100% of the components dissolved therein have number average molecular weights of not more than 100,000. The polyester type resin, more preferably, has at least one peak in a region of molecular weights of 5,000 to 20,000 in the molecular weight distribution.

The molecular weight distribution of the polyester type resin is measured by the GPC with the THF as the solvent.

The polyester resin that is used has an acid value of, desirably, from 0.1 to 100 mgKOH/g, more desirably, from 0.1 to 70 mgKOH/g and, most desirably, from 0.1 to 50 mgKOH/g.

It is, further, desired that its hydroxyl value is not larger than 30 mgKOH/g and, more desirably, from 10 to 25 mgKOH/g.

The amorphous polyester resin and the crystalline polyester resin may be used being mixed together. In this case, it is desired that the materials are selected by taking their compatibilities into consideration.

The amorphous polyester resin is the one synthesized from a polyhydric carboxylic acid component, preferably, an aromatic polyhydric carboxylic acid and a polyhydric alcohol component.

The crystalline polyester resin is the one synthesized from a divalent carboxylic acid component, preferably, an aliphatic dicarboxylic acid and a dihydric alcohol component.

As the binder resin used for the toner of the invention, there can be used the resin which is constituted from the above vinyl polymer component and/or the polyester resin component and also includes monomer components that can react with these two resin components. Among the monomers that constitute the polyester type resin component, those that can react with the vinyl polymer are unsaturated dicarboxylic acids such as phthalic acid, maleic acid, citraconic acid and itaconic acid, as well as anhydrides thereof. Among the monomers that constitute the vinyl polymer component, those that can react with the polyester type resin component are the monomers having a carboxyl group or a hydroxy group, or are (meth)acrylic acid esters.

When the polyester type polymer and/or the vinyl polymer and other binder resins are used in combination, it is desired that not less than 60% by mass of the whole other binder resins have acid values of 0.1 to 50 mgKOH/g.

In the invention, the acid value of the binder resin component of the toner is found in compliance with the basic operations specified under the JIS K-0070. Concretely, the acid value is found according to the method described below.

(1) As a sample, there is provided a toner from which the additives have been removed except the binder resin (polymer component). It is also allowable to use, as the sample, a toner from which the components have not been removed except the binder resin and the crosslinked binder resin. In this case, however, the components, other than the binder resin and the crosslinked binder resin, should have been measured for their acid values and contents thereof. For instance, when the binder resin contained in the toner is to be measured for its acid value, it is recommended that the coloring agent and the magnetic material are separately measured for their acid values and contents, and the acid value of the binder resin is found by calculation.

(2) The sample is pulverized, and 0.5 to 2.0 g of it is accurately weighed. The weight of the polymer component is presumed to be W g.

(3) The sample is put into a 300-ml beaker, and 150 ml of a mixed solution of toluene and ethanol (volume ratio of 4/1) is added therein to dissolve the sample.

(4) By using a potentiometric titration device, titration is conducted by using an ethanol solution of KOH of 0.1 mol/L. The same titration is conducted for the case of the 150 ml of the mixed solution of toluene/ethanol (volume ratio of 4/1), too, to measure the amount of use of the KOH solution at the time of the blank.

(5) The acid value is calculated according to the following formula.

$$\text{Acid value (mgKOH/g)}=[(S-B)\times f\times 5.61]/W$$

wherein,

S is the amount (ml) of the KOH solution that is used,

B is the amount (ml) of the KOH solution used at the time of measuring the blank, f is a factor of the KOH concentration, and W is the weight (g) of the polymer component.

It is desired that the binder resin and the composition containing the binder resin have glass transition temperatures (Tg) of 35 to 80° C. and, specifically, 40 to 75° C. from the standpoint of toner storage property. If Tg is lower than the above range, the toner tends to become deteriorated in a high-temperature atmosphere and, besides, offset tends to develop at the time of fixing. If Tg exceeds the above range, the fixing property tends to decrease.

The polymer toner of the present invention preferably uses the binder resin that has a softening point in a range of 80 to 140° C. If the binder resin has a softening point which is lower than 80° C., the toner and the toner image often lose stability after the fixing and during the storage. If the softening point exceeds 140° C., on the other hand, the fixing property is often deteriorated at low temperatures.

(Magnetic Material)

As the magnetic material that can be used in the invention, there can be exemplified (1) magnetic iron oxides such as magnetite, maghemite and ferrite, as well as iron oxides thereof further containing other metal oxides, (2) metals such as iron, cobalt and nickel, and alloys of these metals with metals such as aluminum, cobalt, copper, lead, magnesium, tin, zinc, antimony, beryllium, bismuth, cadmium, calcium, manganese, selenium, titanium, tungsten and vanadium, and (3) mixtures of iron oxides of (1) and metals or alloys of (2). Here, the iron oxides (1) and the metals or alloys (2) are used in one kind alone or in a combination of two or more kinds.

As the magnetic materials of (1) to (3) above, there can be concretely exemplified $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder and nickel powder. Particularly preferred magnetic material is a fine powder of a tri-iron tetroxide or a $\gamma$-iron sesquioxide.

As the iron oxide of (1), there can be used a magnetic iron oxide such as magnetite, maghemite or ferrite containing elements of different kinds, or mixtures thereof. As the elements of different kinds, there can be exemplified lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. As preferred elements of different kinds, there can be exemplified magnesium, aluminum, silicon, phosphorus and zirconium. The elements of different kinds may be taken into the crystal lattice of the iron oxide or may be taken in the form of an oxide into the iron oxide. The elements of different kinds may be present in the form of oxides or hydroxides on the surfaces of the iron oxide. However, the elements are preferably taken in the iron oxide as oxides.

The above elements of different kinds can be taken into the particles by having the salts of the elements of different kinds mixed therein at the time of forming the magnetic material and adjusting the pH thereof. Or the elements of different kinds can be precipitated on the surfaces of the particles by adjusting the pH after the particles of the magnetic material have been formed or by adjusting the pH by adding the salts of the elements thereto.

It is desired that the magnetic material is used in an amount in a range of 10 to 200 parts by mass and, preferably, 20 to 150 parts by mass per 100 parts by mass of the binder resin. It is desired that the magnetic material has a number average grain size of 0.1 to 2 μm and, more preferably, 0.1 to 0.5 μm. The number average grain size can be found by using a digitizer or the like from a photograph taken on an enlarged scale by using a transmission electron microscope.

It is desired that the magnetic material used in the invention has such magnetic properties as a coercive force of 20 to 150 oersteds, a saturation magnetization of 50 to 200 emu/g and a residual magnetization of 2 to 20 emu/g when impressed with 10 K-oersteds.

(Coloring Agent)

When the magnetic material exhibits black or blue color, it can also be used as a coloring agent. Concretely, black or blue dye or pigment particles are used for the black toner. As the black or blue pigment, there can be exemplified carbon black, Aniline black, acetylene black, Phthalocyanine Blue and Indanthrene Blue. As the black or blue dye, there can be exemplified azo dye, anthraquinone dye, xanthene dye and methine dye.

The coloring agent is used desirably in an amount of 0.1 to 20 parts by mass per 100 parts by mass of the binder resin.

When the magnetic material is to be used for the colored toner as a coloring agent, the following compounds can be used.

As the Magenta coloring agent, there can be used condensed azo compound, diketopyrrolopyrrole compound, anthraquinone compound, quinacridone compound, basic dye, lake dye, naphthol dye, benzimidazolone compound, thioindigo compound and perylene compound. Concrete examples of the pigment type Magenta coloring agents are C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Reds 1, 2, 10, 13, 15, 23, 29 and 35.

The pigment type Magenta coloring agents may be used alone but are desirably used in combination with the following dye type Magenta coloring agents from the standpoint of improving vividness and quality of the full-color image.

As the dye type Magenta coloring agents, there can be used such oil-soluble dyes as C.I. Solvent Reds 1, 3, 8, 23, 24, 25, 27, 30, 49, 81, 82, 83, 84, 100, 109, 121, C.I. Disperse Red 9, C.I. Solvent Violets 8, 13, 14, 21, 27, and C.I. Disperse Violet 1, as well as basic dyes such as C.I. Basic Reds 1, 2, 9, 12, 13, 14, 15, 17, 18, 22, 23, 24, 27, 29, 32, 34, 35, 36, 37, 38, 39, 40 and C.I. Basic Violets 1, 3, 7, 10, 14, 15, 21, 25, 26, 27 and 28.

As the Cyan coloring agent, there can be used copper phthalocyanine compound and derivatives thereof, anthraquinone and basic dye lake compound. Concretely, as the pigment type Cyan coloring agent, there can be exemplified C.I. Pigment Blues 2, 3, 15, 16, 17, C.I. Vat Blue 6, and C.I. Acid Blue 45 or a copper phthalocyanine pigment with its phthalocyanine skeleton being substituted with 1 to 5 phthalimidemethyl groups.

As the Yellow coloring agent, there can be used condensed azo compound, isoindolinone compound, anthraquinone compound, azo metal complex, methine compound and allylamide compound. Concretely, as the Yellow pigment, there can be used C.I. Pigment Yellows 1, 2, 3, 4, 5, 6, 7, 10, 11, 12, 13, 14, 15, 16, 17, 23, 65, 73 and 83, and C.I. Vat Yellows 1, 3 and 20.

As the orange color pigment, there can be used red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK.

As the violet pigment, there can be used manganese violet, Fast Violet B and Methyl Violet Lake.

As the green pigment, there can be used chromium oxide, chrome green, pigment green, Malachite Green Lake and Final Yellow Green G.

As the white pigment, there can be used zinc white, titanium oxide, antimony white and zinc sulfide.

(Other Additives)

A fluidity improving agent may be added to the toner of the invention. Upon being added to the surfaces of the toner, the fluidity improving agent works to improve the fluidity of the toner (so that it easily fluidizes). As the fluidity-improving agent, there can be exemplified fluorine type resin powders such as carbon black, vinylidene fluoride fine powder and polytetrafluoroethylene fine powder; and fine powdery silica such as silica produced by the wet process and silica produced by the dry process, fine powdery titanium oxide and fine powdery alumina, as well as treated silica, treated titanium oxide and treated alumina obtained therefrom by treating their surfaces with a silane coupling agent, a titanium coupling agent or a silicone oil. Among them, preferred examples are fine powdery silica, fine powdery titanium oxide and fine powdery alumina, and more preferred examples are the treated silica, treated titanium oxide and treated alumina obtained therefrom by treating their surfaces with the silane coupling agent or the silicone oil. The fluidity improving agent has an average primary grain size of, preferably, from 0.001 to 2 μm and, particularly preferably, from 0.002 to 0.2 μm.

As the fine powdery silica, there can be preferably used a fine powder obtained from the silicon-halogen compound by the gas-phase oxidation, that is, the so-called dry process silica or fumed silica.

As the fine silica powder formed from the silicon-halogen compound by the gas-phase oxidation, there can be exemplified those placed in the market in the trade names described below. AEROSIL (manufactured by Nippon Aerosil Co., Ltd., hereinafter the same)-130, -300, -380, -TT600, -MOX170, -MOX80 and -COK84; Ca—O-Sil (manufactured by Cabot Corporation, hereinafter the same)-M-5, -MS-7, -MS-75, -HS-5 and -EH-5; Wacker HDK (manufactured by Wacker-Chemie GmbH, hereinafter the same)-N20 V15, -N20E, -T30, -T40; D-C Fine Silica (manufactured by Dow Coning Corporation); and Fransol (manufactured by Fransil Co.).

More preferred is a fine treated silica powder obtained by treating the fine silica powder to be hydrophobic. The fine silica powder so treated as to exhibit a hydrophobic degree of 30 to 80% is particularly preferred. The hydrophobic degree is measured by the methanol titration testing. The treatment for imparting hydrophobic property is based on the chemical or physical treatment by using an organosilicon compound that either reacts with, or physically adsorbs, the fine silica powder. As for the treatment for imparting hydrophobic property, it is desired to treat the fine silica powder obtained from the silicon-halogen compound through the gas-phase oxidation with the organosilicon compound.

The fluidity improving agent has a number average grain size of, desirably, 5 to 100 nm and, more desirably, 5 to 50 nm. Its BET specific surface area is, desirably, not less than 30 $m^2/g$ and, more desirably, 60 to 400 $m^2/g$. When the fluidity improving agent is surface-treated fine powders, the BET specific surface area of the fine powders is, preferably, not less than 20 $m^2/g$, much preferably, 40 to 300 $m^2/g$. The BET specific surface area stands for a specific surface area based on the nitrogen adsorption as measured according to the BET method.

The fine powder is used in an amount of, preferably, 0.03 to 8 parts by mass per 100 parts by mass of the toner particles.

To protect the photosensitive material and carrier, to improve cleaning property, to adjust thermal properties, electric properties and physical properties, to adjust the resistance, to adjust the softening point and to improve the fixing ratio, the toner of the present invention can be, further, blended as required with other additives such as various kinds of metal soaps; fluorine type surfactant; dioctyl phthalate; tin oxide, zinc oxide, carbon black and antimony oxide for imparting electrically conducting property; and inorganic fine powders such as titanium oxide, aluminum oxide and alumina. As required, these inorganic fine powders may be treated to be hydrophobic. It is, further, allowable to use lubricating agents such as polytetrafluoroethylene, zinc stearate and vinylidene polyfluoride, as well as polishing agents such as cesium oxide, silicon carbide and strontium titanate, and anti-caking agent. There can be, further, used, as developing improving agents and in small amounts, fine white particles and fine black particles of a polarity opposite to the toner particles.

It is also desired to treat these additives with treating agents such as silicone varnish, various modified silicone varnishes, silicone oil, various modified silicone oils, silane coupling agent, silane coupling agent having functional group, or any other organosilicon compound, or with various treating agents in order to control the amount of electric charge.

(Toner of the Invention)

The toner of the present invention remains thermally stable, i.e., is free from receiving thermal change at the time of electrophotographic processing and is capable of stably maintaining electrically charging properties. Besides, it homogeneously disperses in any binder resin accounting for a very homogeneous electric charge distribution in the fresh toner. By using the toner of the invention, therefore, almost no change is exhibited in the saturated amount of charge by friction or in the electric charge distribution among the untransferred toner, recovered toner (waste toner) or fresh toner. When the waste toner resulting from the toner for developing electrostatic charge image of the invention is to be used again, however, the difference between the fresh toner and the waste toner can be, further, decreased by selecting a polyester resin containing an aliphatic diol as a binder resin or by selecting a styrene-acrylate copolymer crosslinked with a metal as a binder resin, and by producing the toner by adding a large amount of polyolefin thereto.

(Method of Producing the Toner)

The toner of the invention can be produced by a known method but is desirably produced by a pulverization method. The pulverization method is a method of obtaining a toner by mixing the above-mentioned materials for constituting the toner, such as binder resin, charge control agent and coloring agent in a mixer such as ball mill to a sufficient degree, well kneading the mixture thereof in a heating/kneading apparatus such as hot roll kneader, cooling and solidifying the mixture, pulverizing the mixture and classifying the mixture.

The toner can also be produced by a method of dissolving the above mixture in a solvent and spraying the solvent so as to be atomized, drying and classifying. The toner can be, also, produced by mixing the predetermined materials to a monomer that will constitute the binder resin so as to be emulsified or so as to form a suspension solution thereof, followed by polymerization (polymerization method). The toner can, also, be produced as the so-called microcapsular toner comprising the core material and the shell material, by adding predetermined materials to the core material or/and to the shell material. As required, the desired additives and toner particles may be mixed together to a sufficient degree in a mixer such as Henschel's mixer to produce the toner of the invention.

The method of producing the toner of the invention based on the pulverization will be described below in further detail. First, the binder resin, coloring agent, charge control agent and other additives that are necessary are homogeneously mixed together. The mixing is done by using a known stirrer such as Henschel's mixer, super-mixer or ball mill. The obtained mixture is heat-melt-kneaded by using a closed-type kneader or a monoaxial or biaxial extruder. After cooled, the kneaded product is roughly pulverized by using a crusher or a hammer mill and is, thereafter, finely pulverized by using a pulverizer such as jet mill or high-speed rotor mill. The kneaded product is, further, classified to a predetermined grain size by using a pneumatic classifier such as elbow jet of the type of inertial classification by utilizing the Coanda effect, microplex of the type of cyclone (centrifugal) classification or DS separator. Further, when the surfaces of the toner are to be treated with an external agent, the toner and the external agent are stirred and mixed together in a high-speed stirrer such as Henschel's mixer or super-mixer.

The toner of the invention can be produced by the polymerization method, too. The polymerization method includes a suspension polymerization method and an emulsion polymerization method.

The suspension polymerization method consists of homogeneously dissolving or dispersing a polymerizable monomer, coloring agent, polymerization initiator, charge control agent and other additives used as required, such as crosslinking agent and dispersion stabilizer to prepare a monomer composition and, thereafter, dispersing the monomer composition in a continuous phase (e.g., aqueous phase) containing a dispersion stabilizer by using a suitable stirrer or a dispersing machine such as homo-mixer, homogenizer, atomizer, micro-fluidizer, one-liquid fluid nozzle, gas-liquid fluid nozzle or electric emulsifier. It is desired to carry out the granulation by so adjusting the stirring rate, temperature and time that the liquid droplets of the polymerizable monomer composition will assume a desired size of toner particles. Simultaneously with the dispersion, the polymerization reaction is conducted at 40 to 90° C. to obtain toner particles having a desired grain size. The obtained toner particles are washed, filtered and dried. The toner particles that are produced can be externally treated by the method described above.

The toner particles produced by the emulsion polymerization method has superior homogeneity to the particles obtained by the suspension polymerization method, but has an average grain size of as very small as 0.1 to 1.0 μm. Depending on the cases, therefore, it becomes necessary to carry out the so-called seed polymerization to grow the particles by adding a polymerizable monomer to the nuclei of emulsified particles. Further, the toner particles may be produced by a method of merging and melt-adhering together the emulsified particles up to a suitable average grain size.

The production based on these polymerization methods eliminates the need for imparting brittleness to the toner particles since no pulverization step is conducted and permits the use of low-softening materials in large amounts, that could not be used so far for the pulverization method, broadening the range of selection of the materials. Further, since the parting agent and the coloring agent which are hydrophobic materials are exposed little on the surfaces of the toner particles, it is allowed to reduce contamination upon the toner carrier members, photosensitive material, transfer rollers and fixing device.

The toner of the invention produced by the polymerization method features further improved properties such as image reproduceability, transfer property and color reproduceability. It is, further, allowable to decrease the grain size of the toner to cope with fine dots and, therefore, to relatively easily obtain the toner having a sharp grain size distribution.

The toner obtained by the above polymerization method has a smaller degree of ruggedness of toner particles than the toner obtained by the pulverization method without any specific treatment and is, further, amorphous accounting for an increased contact area between the electrostatic latent image carrier and the toner and an increased adhering force of the toner. As a result, the interior of the machine is contaminated less, and images of a higher density and higher quality are obtained.

The toner produced by the pulverization method, too, can have a decreased degree of roughness on the surfaces thereof upon being passed through a hot bath method in which the toner particles are dispersed in water and heated, a heat treatment method which passes the toner particles through the hot air stream or a mechanical impact method which treats the toner particles by imparting mechanical energy thereto. As the apparatus for decreasing the degree of roughness, there can be exemplified a mechanofusion system (manufactured by HOSOKAWA MICRON CORPORATION) which is based on a dry mechanochemical method, I-type jet mill, hybridizer (manufactured by NARA MACHINERY CO., LTD.) which is a mixing apparatus having a rotor and a liner, and Henschel's mixer which is a mixer having high-speed stirrer vanes.

As a value which represents the degree of ruggedness of the toner particles, there is an index called average degree of circularity (C). The average degree of circularity (C) stands for a value obtained by finding the degree of circularity (Ci) according to the following formula and, thereafter, dividing the sum of the degrees of circularity of all particles that are measured by the number (m) of all particles that are measured according to the following formula.

$$\text{Degree of circularity } (Ci) = a/b$$

wherein a is a circumferential length of a circle having the same projected area as the particle, and b is a circumferential length of the projected image of the particle, Average degree of circularity $$(C) = \sum_{i=1}^{m} Ci/m$$

wherein m is the number of all particles measured.

The degree of circularity (Ci) is measured by using a flow-type particle image analyzer (e.g., FPIA-1000 manufactured by TOA ELECTRIC CO., LTD.). Concretely, a dispersion solution is prepared by dispersing about 5 mg of the toner in 10 ml of an aqueous solution in which about 0.1 mg of a nonionic surfactant has been dissolved, ultrasonic waves (20 kHz, 50 W) are applied to the dispersion solution for 5 minutes so that the concentration of the dispersion solution becomes 5,000 to 20,000 particles/μL and by using the flow-type particle image measuring apparatus, the dispersion solution is measured for its distribution of circularity degrees of particles having equivalent circle diameters of not less than 0.60 μm but less than 159.21 μm.

The value of average degree of circularity (C) is, desirably, from 0.955 to 0.995. When the value of average degree of circularity (C) is from 0.960 to 0.985, the toner remains less after the transfer of image and, therefore, the re-transfer of image takes place little, which is more desirable.

When the toner of the invention is produced by the pulverization method, the grain size of the toner is, desirably, from 2 to 15 μm and is more desirably, from 3 to 12 μm in terms of the average grain size on the volume basis. The grain size of the toner can be measured by using a laser type grain size distribution measuring apparatus such as Micron Photo Sizer (manufactured by SEISHIN ENTERPRISE Co., Ltd.). If the average grain size exceeds the above range, the resolution and sharpness tend to become dull. If the average grain size is smaller than the above range, the resolution is improved but the yield of producing the toner decreases arousing such problems as increased cost, scattering of toner in the machine, and health problems such as permeation into the skin.

When the toner of the invention is to be produced by the polymerization method, on the other hand, the toner should have a volume average grain size of, preferably, from 3 to 9 μm, more preferably, from 4 to 8.5 μm and, specifically, from 5 to 8 μm. If the volume average grain size is smaller than the above range, the fluidity of the toner decreases and the charging property of the particles decreases. Besides, since the distribution of charge expands, background fogging easily occurs, and the toner tends to spill over the developer. Further, it often becomes difficult to conduct the cleaning. If the volume average grain size is larger than the above range, the resolution decreases, picture quality is not obtained to a sufficient degree, and it often becomes difficult to meet the recent requirement of high picture quality.

In the toner of the invention produced by the polymerization method, it is desired that the volume average grain size distribution index (GSDv) is from 1.15 to 1.30 and, more desirably, from 1.1-5 to 1.25. The volume average grain size distribution index is found in a manner as described below. That is, the grain size distribution of the toner is measured by a method that is described below. The obtained grain size distribution is divided into specific grain size ranges (channels). In the grain size ranges, the cumulative distribution is drawn depending on the volume starting from the small diameter side. The grain size with which the cumulative volume becomes 16% is defined as volume D 16%, the grain size with which the cumulative volume becomes 50% is defined as volume D 50%, and the grain size with which the cumulative volume becomes 84% is defined as volume D 84%. A value calculated from $(D84\%/D16\%)^{1/2}$ is regarded to be a volume average grain size distribution index (GSDv).

In the present invention, the grain size distribution of the toner is measured by using, for example, the Coulter counter (TA-II manufactured by Beckman Coulter, Inc.). The grain size distribution of the toner of the invention is desirably such that the content of particles of not larger than 2 μm is 10 to 90% on the particle number basis and the content of particles of not smaller than 12.7 μm is 0 to 30% on the volume basis.

It is, further, desired that the toner of the present invention has highly homogeneous grain sizes (volume average grain size/number average grain size of 1.00 to 1.30).

The BET specific surface area of the toner of the invention is, desirably, from 1.2 to 5.0 $m^2/g$ and is, more desirably, from 1.5 to 3.0 $m^2/g$. The BET specific surface area is measured by using, for example, a BET specific surface area measuring apparatus (e.g., FlowSorb ii2300 manufactured by Shimadzu Corporation). Namely, the gas adsorbed by the surfaces of the toner is removed at 50° C. for 30 minutes, quenched with the liquid nitrogen and the nitrogen gas is adsorbed again. The temperature is elevated again to 50° C., and the value found from the amount of the gas that is removed at this moment is defined to be the BET specific surface area. Nitrogen is used as the gas to be adsorbed and removed.

The apparent specific gravity (bulk density) of the toner of the invention is measured by using, for example, a powder tester (manufactured by HOSOKAWA MICRON CORPORATION). When the toner of the invention is a non-magnetic toner, the apparent specific gravity is, desirably, from 0.2 to 0.6 $g/cm^3$. When the toner of the invention is a magnetic toner, the apparent specific gravity is, desirably, from 0.2 to 2.0 $g/cm^3$ though it may vary depending upon the kind and content of the magnetic powder.

When the toner of the invention is the non-magnetic toner, the true specific gravity of the toner is, desirably, from 0.9 to 1.2 $g/cm^3$ and when the toner of the invention is the magnetic toner, the true specific gravity of the toner is, desirably, from 0.9 to 4.0 $g/cm^3$ though it may vary depending upon the kind and content of the magnetic powder. The true specific gravity of the toner is calculated in a manner as described below. Namely, 1.000 g of the toner is accurately weighed and is introduced into a 10 mmϕ tablet-forming mold, and is compression-formed in vacuum under a pressure of 200 $kgf/cm^2$. The thus formed cylindrical article is measured for its height by using a micrometer. The true specific gravity is calculated from the measured value.

The fluidity of the toner is defined by, for example, the dynamic angle of repose and the static angle of repose as measured by using the angle of repose-measuring apparatus (manufactured by, for example, TSUTSUI SCIENTIFIC INSTRUMENTS CO., LTD.). The dynamic angle of repose of the toner of the invention is, desirably, from 5 degrees to 45 degrees and the static angle of repose is, desirably, from 10 to 50 degrees.

When the toner of the invention is the toner produced by the pulverization method, it is desired that an average value of the shape coefficients (SF-1) of the toner is 100 to 400 and the average value of the shape coefficients 2 (SF-2) is 100 to 350.

The shape coefficients SF-1 and SF-2 of the toner are obtained as described below. By using, for example, an optical microscope (e.g., BH-2 manufactured by OLYMPUS CORPORATION) equipped with a CCD camera, a group of toner particles is magnified by 1000 times, and an image is so obtained that about 30 particles are included in each visual field. From the obtained image and by using an image analyzer (e.g., LUZEX FS manufactured by Nireco Corporation), each particle is measured for its maximum length, projected area and circumferential length. The above operations for taking the images and analysis are repeated until the values thereof are obtained for about 1000 toner particles. The shape coefficients are calculated from the obtained values. The shape coefficients (SF-1) and the shape coefficients 2 (SF-2) are calculated in compliance with the following formulas.

$$SF\text{-}1=\{(ML^2\times\pi)/4A\}\times 100$$

wherein

ML is a maximum length of the particle, and

A is a projected area of a particle, $$SF\text{-}2=\{PM^2/4A\pi\}\times 100$$

wherein

PM is a circumferential length of the particle, and

A is a projected area of the particle.

The value SF-1 represents distortion of the particles. If the particles are close to spheres, the value SF-1 approaches 100. If slender, the value SF-1 increases further.

The value SF-2 represents roughness of the particles. If the particles are close to spheres, the value SF-2 approaches 100. If the particles have complex shapes, the value SF-2 increases further.

When the toner of the invention is the non-magnetic toner, the volume resistivity of the toner is, desirably, from $1\times10^{12}$ to $1\times10^{16}$ Ω·cm. When the toner is the magnetic toner, the volume resistivity of the toner is, desirably, from $1\times10^{8}$ to $1\times10^{16}$ Ω·cm though it may vary depending on the kind and content of the magnetic powder. The volume resistivity of the toner is calculated as described below. That is, the toner particles are compression-formed to prepare a disk-like test piece 50 mm in diameter and 2 mm in thickness. The test piece is set onto the electrodes for solid material (e.g., SE-70 manufactured by Ando Electric Co., Ltd.), and a DC voltage of 100 V is continuously applied thereto by using an insulation resistance tester (e.g., 4339A manufactured by Hewlett-Packard Department Company, L.P.). The resistivity after the continuous application of voltage for one hour is defined to be the volume resistivity.

When the toner of the invention is the non-magnetic toner, the dielectric loss tangent of the toner is, desirably, from $1.0\times10^{-3}$ to $15.0\times10^{-3}$. When the toner is the magnetic toner, the dielectric loss tangent is, desirably, from $2\times10^{-3}$ to $30\times10^{-3}$ though it may vary depending on the kind and content of the magnetic powder. The dielectric loss tangent of the toner is calculated as described below. That is, the toner particles are compression-formed to prepare a disk-like test piece 50 mm in diameter and 2 mm in thickness. The test piece is set onto the electrodes for solid material, and is measured for its dielectric loss tangential value (Tan δ) under the conditions of a measuring frequency of 1 KHz and a peak-to-peak voltage of 0.1 KV by using an LCR meter (e.g., 4284A manufactured by Hewlett-Packard Department Company, L.P.).

The toner of the invention has an Izod impact value of, desirably, from 0.1 to 30 kg·cm/cm. The Izod impact value of the toner is measured as described below. That is, the toner particles are heat-melted to prepare a plate-like test piece. The test piece is measured for its Izod impact value in compliance with the JIS Standard K-7110 (Impact Testing Method of Hard Plastics).

The toner of the invention has a melt index (MI value) of, desirably, from 10 to 150 g/10 min. The melt index (MI value) of the toner is measured in compliance with the JIS Standard K-7210 (Method A). The measuring conditions consist of a measuring temperature of 125° C. and a weight of 10 kg.

The toner of the invention has a melt start temperature of, desirably, from 80 to 180° C. and a 4 mm fall-down temperature of, desirably, from 90 to 220° C.

The melt start temperature of the toner is measured as described below. That is, the toner particles are compression-formed to prepare a cylindrical test piece 10 mm in diameter and 20 mm in thickness. The test piece is set onto a heat melt property-measuring apparatus such as flow tester (e.g., CFT-500C manufactured by Shimadzu Corporation), and is measured for its temperature at a moment when the piston starts falling under a condition of a load of 20 kgf/cm$^2$. This temperature is defined to be the melt start temperature based on an idea that the piston starts falling when the toner starts melting.

Based on the same measuring method, further, the temperature is measured at a moment when the piston falls down by 4 mm. This temperature is defined to be the 4 mm fall-down temperature.

The toner of the invention has a glass transition temperature (Tg) of, desirably, from 35 to 80° C. and, more preferably, from 40 to 75° C. If Tg of the toner is lower than the above range, the offset resistance and storage stability tend to decrease. If Tg of the toner exceeds the above range, the fixing strength of picture tends to decrease.

The glass transition temperature of the toner is measured by using the differential scanning calorimeter (DSC) as described below. That is, the glass transition temperature (Tg) is found from a peak value in a change of phase that appears when the toner is heated at a constant heating rate, quenched and is heated again.

As for the endothermic peak of the toner of the invention measured by the DSC, it is desired that a peak-top temperature of a maximum peak lies in a zone of 70 to 120° C.

The toner of the invention has a melt viscosity of, preferably, from 1,000 to 50,000 poises and, more preferably, from 1,500 to 38,000 poises. The melt viscosity of the toner is measured as described below. That is, the toner particles are compression-formed to prepare a cylindrical test piece 10 mm in diameter and 20 mm in thickness. The test piece is set onto a heat-melt property measuring apparatus, e.g., a flow tester (CFT-500C manufactured by Shimadzu Corporation) and is measured for its melt viscosity under a condition of a load of 20 kgf/cm$^2$.

It is desired that the components of the toner of the invention that remain without being dissolved in the solvents comprise 0 to 30% by mass of the component that does not dissolve in the THF, 0 to 40% by mass of the component that does not dissolve in the ethyl acetate, and 0 to 30% by mass of the component that does not dissolve in the chloroform. The components that remain without being dissolved in the solvents are measured as described below. That is, one gram of the toner is homogeneously dissolved or dispersed in 100 ml of each of the THF, ethyl acetate and chloroform. The solutions or the dispersion solutions are filtered with pressure. The filtrates are dried and are determined, and from which the ratios of the components of the toner that did not dissolve in the organic solvents are calculated.

The toner of the invention can be used for the one-component developing system. The one-component developing system is one of the image-forming methods and develops an image by feeding the toner in the form of a thin film onto a latent image carrier. The toner is formed into a thin film, usually, by using an apparatus that comprises a toner conveyer member, a toner layer thickness limiting member and a toner feed assist member, the feed assist member and the toner conveyer member being in contact with each other, and the toner layer thickness limiting member and the toner conveyer member being in contact with each other.

The toner of the invention can also be used for the two-component developing system. Concretely described below is how to apply the toner of the invention to the two-component developing system. The two-component developing system uses the toner and the carrier (having roles as a charge-imparting agent and as a toner conveyer member). The two-component developing system is carried out as described below. The developing agent (toner and carrier) is stirred by a stirrer member to generate electric charge of a predetermined amount, and is conveyed by a magnet roller or the like to a developing portion. The developing agent is held on the surface of the magnet roller due to the magnetic force, and a magnetic brush is formed in the form of a layer being limited to a suitable height by a developing agent limiting plate and the like. Accompanying the rotation of the developing roller, the developing agent moves on the roller and is brought in contact with the electrostatic latent image-holding member or is opposed thereto in a non-contacting manner maintaining a predetermined gap to develop and visualize the latent image. When developed in a non-contacting manner, a DC electric field may be established between the developing agent and the latent image-holding member to produce a driving force for flying the toner in space of a predetermined gap. To obtain a more vivid image, however, the invention can be applied to a system in which an alternating current is superposed.

(Carrier)

As the carrier used for the two-component developing system, there can be used a resin-coated carrier in addition to general carriers such as ferrite and magnetite.

The toner of the invention is used in an amount of, desirably, 1 to 200 parts by mass and, more desirably, 2 to 50 parts by mass per 100 parts by mass of the carrier.

The resin-coated carrier comprises carrier core particles and a coating material. The coating material is a resin for covering the surfaces of the carrier core particles. As the resin for the coating material, there can be preferably used styrene-acrylate resin such as styrene-acrylic ester copolymer and styrene-methacrylic ester copolymer; acrylate resins such as acrylic ester copolymer and methacrylic ester copolymer; fluorine-contained resins such as polytetrafluoroethylene, monochlorotrifluoroethylene polymer and vinylidene polyfluoride; silicone resin; polyester resin; polyamide resin; polyvinyl butyral; and aminoacrylate resin. There can be, further, used any resins that work to cover the carrier, such as ionomer resin, polyphenylene sulfide resin and the like resins. These resins can be used in one kind alone or in a combination of two or more kinds.

As the carrier cores, there can be also used carrier cores of the binder type comprising a magnetic powder dispersed in a resin.

The resin-coated carrier can be obtained by a method of coating the surfaces of the carrier cores with at least a resin coating agent, i.e., by a method of dissolving or suspending the resin in a solvent so as to apply or adhere the resin onto the carrier cores, or a method of mixing the carrier core particles and the coating resin in the form of powders together. The ratio of the resin coating material to the resin-coated carrier may be suitably determined, but is, preferably, from 0.01 to 5% by mass and, more preferably, from 0.1 to 1% by mass.

As for coating the magnetic material (carrier) with the coating agent of a mixture of two or more kinds, there can be exemplified (1) a case of treating 100 parts by mass of the fine titanium oxide powder with 12 parts by mass of a mixture of dimethyldichlorosilane and dimethylsilicon oil (mass ratio of 1:5), and (2) a case of treating 100 parts by mass of the fine silica powder with 20 parts by mass of a mixture of dimethyldichlorosilane and dimethylsilicon oil (mass ratio of 1:5).

As for the resin for the coating material, it is desired to use the styrene-methyl methacrylate copolymer, a mixture of the fluorine-contained resin and the styrene copolymer, or the silicone resin and, specifically, the silicone resin.

As the mixture of the fluorine-contained resin and the styrene copolymer, there can be used a mixture of vinylidene polyfluoride and styrene-methyl methacrylate copolymer; a mixture of polytetrafluoroethylene and styrene-methyl methacrylate copolymer; and a mixture of vinylidene fluoride-tetrafluoroethylene copolymer (copolymer mass ratio of 10:90 to 90:10), styrene-acrylic acid-2-ethylhexyl copolymer (copolymer mass ratio of 10:90 to 90:10) and styrene-acrylic acid-2-ethylhexyl-methyl methacrylate copolymer (copolymer mass ratio of 20:60:5 to 30:10:50).

As the silicone resin, there can be used a nitrogen-contained silicone resin and a modified silicone resin formed by the reaction of a nitrogen-contained silane coupling agent with a silicone resin.

As the magnetic material for the carrier cores, there can be used oxides such as ferrite, excess iron-type ferrite, magnetite and γ-iron oxide, metals such as iron, cobalt or nickel, or alloys thereof. As the elements contained in the magnetic materials, there can be exemplified iron, cobalt, nickel, aluminum, copper, lead, magnesium, tin, zinc, antimony, beryllium, bismuth, calcium, manganese, selenium, titanium, tungsten and vanadium. Preferably, there can be used copper-zinc-iron ferrite comprising chiefly copper, zinc and iron component, and manganese-magnesium-iron ferrite comprising chiefly manganese, magnesium and iron component.

The carrier has a resistivity of, preferably, $10^6$ to $10^{10}$ Ω·cm. The resistivity can be adjusted by adjusting the roughness on the surfaces of the carrier or the amount of the resin for covering. The carrier has a grain size of, preferably, 4 to 200 μm, more preferably, 10 to 150 g m and, most preferably, 20 to 100 μm. Specifically, the resin-coated carrier has a 50%-grain size of 20 to 70 μm.

EXAMPLES

The invention will now be described by way of Examples which, however, are in no way to limit the invention. In Examples, "parts" are all "parts by mass".

Example 1

Preparation of a Non-Magnetic Toner 1

As starting materials, use was made of a styrene-acrylate copolymer resin (trade name, CPR-100, acid value: 0.1 mgKOH/g, manufactured by Mitsui Chemicals, Inc.), a rhodanine compound (charge control agent No. 1) of the following structural formula, carbon black (trade name, MA-100, manufactured by Mitsubishi Chemical Corporation), and a wax (hereinafter called BCSP wax) synthesized from a mixture of β-cytosterol, campesterol and stigmasterol at a ratio of 2:1:1 (w/w/w) and palmitic acid. The starting materials were melted and mixed together by using a heat-mixing device (biaxial extruder-kneader) heated at 130° C. to comply with the following composition:

| | |
|---|---|
| styrene-acrylate copolymer resin | 91 parts |
| charge control agent No. 1 | 1 part |
| carbon black | 5 parts |
| BCSP wax | 3 parts |

The mixture after cooled was roughly pulverized by a hammer mill, finely pulverized by a jet mill, and was classified to obtain a non-magnetic toner 1 having a volume average grain size of 9±0.5 μm.

The BCSP wax that was used possessed a melting point of 89° C.

[Chemical 11]

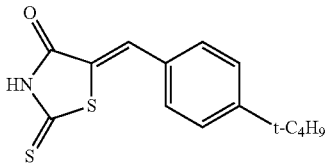

(Charge control agent No. 1)

(Evaluating the Non-Magnetic Toner 1)

The obtained toner and a non-coated ferrite carrier (F-150 manufactured by Powdertech) were mixed and shaken together to negatively charge the toner. The mixing ratio was 4 to 100 parts by mass (toner:carrier). After electrically charged, the amount of electric charge was measured by using a blow-off powder electric charge-measuring apparatus. The result was as shown in Table 1.

Further, the obtained toner was evaluated for its environmental stability under high-temperature and high-humidity conditions (30° C., 85% RH). Namely, the saturated amount of electric charge under high-temperature and high-humidity condition was compared with the saturated amount of electric charge in normal atmosphere (temperature of 25° C. and humidity of 50%), and a drop in the saturated amount of electric charge under high-temperature and high-humidity condition was found from the saturated amount of electric charge in normal atmosphere (hereinafter called a drop of saturated electric charge), and the environmental stability was evaluated on the basis of the following four steps. The result was as shown in Table 1.

◎: Stable (drop of saturated electric charge was less than 5%)

○: Fairly stable (drop of saturated electric charge was not less than 5% but was less than 10%)

Δ: Slightly unstable (drop of saturated electric charge was not less than 10% but was less than 15%)

X: Unstable (drop of saturated electric charge was not less than 15%)

Comparative Example 1

Preparation of a Non-Magnetic Toner 1 for Comparison and its Evaluation

A non-magnetic toner 1 for comparison was prepared in the same manner as in Example 1 but using a low-molecular polypropylene (trade name, VISCOL 550P, manufactured by Sanyo Chemical Industries, Ltd.) (hereinafter called low-molecular polypropylene) instead of using the BCSP wax. The amount of the electric charge was measured and the environmental stability was evaluated in the same manner as in Example 1. The results were as shown in Table 1.

The low molecular polypropylene that was used possessed a melting point of 152° C.

Example 2

Preparation of a Non-Magnetic Toner 2

A non-magnetic toner 2 was prepared in the same manner as in Example 1 but using an iron complex compound (charge control agent No. 2) of the following structural formula instead of using the charge control agent No. 1. The amount of the electric charge was measured and the environmental stability was evaluated in the same manner as in Example 1. The results were as shown in Table 1.

[Chemical 12]

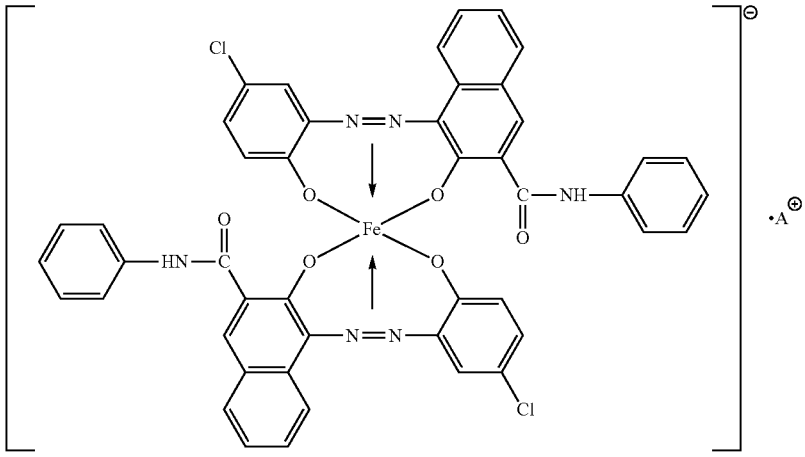

(Charge control agent No. 2)

wherein $A_1^+$ is a mixed cation of hydrogen ion, sodium ion and ammonium ion.

Comparative Example 2

Preparation of a Non-Magnetic Toner 2 for Comparison and its Evaluation

A non-magnetic toner 2 for comparison was prepared in the same manner as in Example 2 but using the low-molecular polypropylene instead of using the BCSP wax. The amount of the electric charge was measured and the environmental stability was evaluated in the same manner as in Example 2. The results were as shown in Table 1.

Example 3

Preparation of a Non-Magnetic Toner 3

A non-magnetic toner 3 was prepared in the same manner as in Example 1 but using a zirconium compound (charge control agent No. 3) of the following structural formula instead of using the charge control agent No. 1. The amount of the electric charge was measured and the environmental stability was evaluated in the same manner as in Example 1. The results were as shown in Table 1.

[Chemical 13]

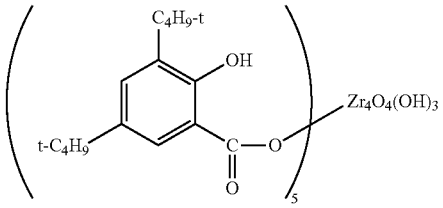

(Charge control agent No. 3)

Comparative Example 3

Preparation of a Non-Magnetic Toner 3 for Comparison and its Evaluation

A non-magnetic toner 3 for comparison was prepared in the same manner as in Example 3 but using the low-molecular polypropylene instead of using the BCSP wax. The amount of the electric charge was measured and the environmental stability was evaluated in the same manner as in Example 3. The results were as shown in Table 1.

Example 4

Preparation of a Non-Magnetic Toner 4

A non-magnetic toner 4 was prepared in the same manner as in Example 1 but using an iron complex compound (charge control agent No. 4) of the following structural formula instead of using the charge control agent No. 1. The amount of the electric charge was measured and the environmental stability was evaluated in the same manner as in Example 1. The results were as shown in Table 1.

[Chemical 14]

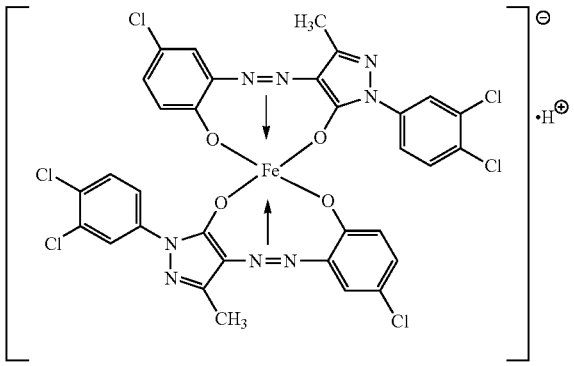

(Charge control agent No. 4)

Comparative Example 4

Preparation of a Non-Magnetic Toner 4 for Comparison and its Evaluation

A non-magnetic toner 4 for comparison was prepared in the same manner as in Example 4 but using the low-molecular polypropylene instead of using the BCSP wax. The amount of the electric charge was measured and the environmental stability was evaluated in the same manner as in Example 4. The results were as shown in Table 1.

Example 5

Preparation of a Non-Magnetic Toner 5

A non-magnetic toner 5 was prepared in the same manner as in Example 1 but using a cyclic phenol sulfide (charge control agent No. 5) of the following structural formula instead of using the charge control agent No. 1. The amount of the electric charge was measured and the environmental stability was evaluated in the same manner as in Example 1. The results were as shown in Table 1.

[Chemical 15]

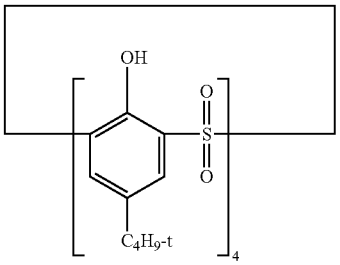

(Charge control agent No. 5)

Comparative Example 5

Preparation of a Non-Magnetic Toner 5 for Comparison and its Evaluation

A non-magnetic toner 5 for comparison was prepared in the same manner as in Example 5 but using the low-molecular polypropylene instead of using the BCSP wax. The amount of the electric charge was measured and the environmental stability was evaluated in the same manner as in Example 5. The results were as shown in Table 1.

TABLE 1

| Toner | Amount of electric charge (μC/g) | Environmental stability |
|---|---|---|
| Ex. 1 | −43.2 | ◎ |
| Ex. 2 | −23.7 | ◎ |
| Ex. 3 | −20.3 | ◎ |
| Ex. 4 | −27.1 | ◎ |
| Ex. 5 | −28.6 | ◎ |
| Comp. Ex. 1 | −41.5 | X |
| Comp. Ex. 2 | −21.0 | X |
| Comp. Ex. 3 | −17.5 | Δ |
| Comp. Ex. 4 | −25.7 | Δ |
| Comp. Ex. 5 | −26.4 | X |

From the results of Table 1, it was learned that the toners of the present invention using the plant sterol wax exhibited excellent electrically charging property as well as improved environmental stability under high-temperature and high-humidity conditions.

INDUSTRIAL APPLICABILITY

According to the present invention, there is provided a toner for developing electrostatic charge image, which is capable of suppressing a decrease in the image quality caused by shading in the luster of the image or by the fouling on the image for extended periods of time, and is suited for attaining the fixing at low temperatures.

The invention, further, provides a toner for developing electrostatic charge image, which can be electrically charged to a sufficient degree by friction, shows a quick rise in the electric charge, excels in stably maintaining the electric charge for extended periods of time and in environmentally remaining stabile, and is free from the problem in regard to regulations concerning the waste materials.

The invention claimed is:

1. A toner for developing electrostatic charge image containing a wax obtained by the reaction of a plant sterol with a higher fatty acid, a coloring agent and a binder resin.

2. The toner for developing electrostatic charge image according to claim 1, wherein said plant sterol is a phytosterol.

3. The toner for developing electrostatic charge image according to claim 1, further containing a charge control agent.

4. The toner for developing electrostatic charge image according to claim 3, wherein the charge control agent is an iron complex compound represented by the following general formula (1),

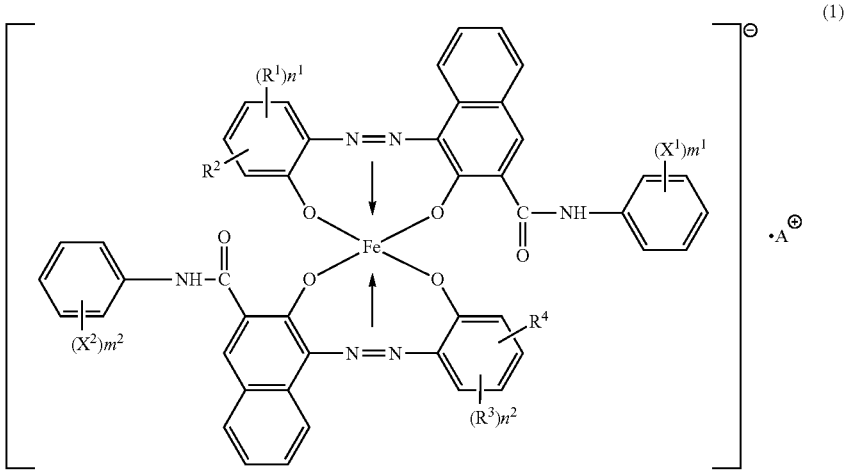

(1)

wherein, $X^1$ and $X^2$ may be the same or different, and are fluorine atoms, chlorine atoms, bromine atoms, iodine atoms, nitro groups, alkyl groups having 1 to 4 carbon atoms, or alkyloxy groups having 1 to 4 carbon atoms;

$m^1$ and $m^2$ are integers of 0 to 3;

$R^1$ and $R^3$ may be the same or different, and are fluorine atoms, chlorine atoms, bromine atoms, iodine atoms, alkyl groups having 1 to 18 carbon atoms, alkyloxy groups having 1 to 18 carbon atoms, alkenyl groups having 2 to 6 carbon atoms, sulfonamide groups, sulfonalkyl groups having 1 to 18 carbon atoms, sulfonic acid groups, carboxyl groups, carboxy ester groups, hydroxyl groups, acetylamino groups or benzoylamino groups, $n^1$ and $n^2$ are integers of 0 to 3, $R^2$ and $R^4$ are hydrogen atoms or nitro groups, $A^+$ is a hydrogen ion, sodium ion, potassium ion, ammonium ion or alkylammonium ion, and when $X^1$, $X^2$, $R^1$ or $R^3$ is present in plural numbers on the same benzene ring, the pluralities of $X^1$, $X^2$, $R^1$ or $R^3$ may be the same or different respectively.

5. The toner for developing electrostatic charge image according to claim 3, wherein the charge control agent is a zirconium compound represented by the following general formula (2),

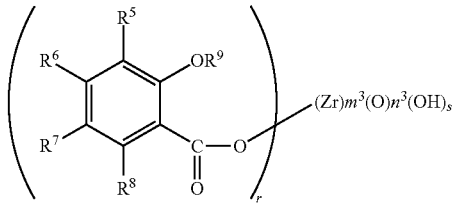

(2)

wherein, $R^5$, $R^6$, $R^7$ and $R^8$ may be the same or different, and are hydrogen atoms, fluorine atoms, chlorine atoms, bromine atoms, iodine atoms, hydroxyl groups, carboxyl groups, nitro groups, nitroso groups, cyano groups, alkyl groups having 1 to 6 carbon atoms, cycloalkyl groups having 5 or 6 carbon atoms, alkenyl groups having 2 to 6 carbon atoms, alkyloxy groups having 1 to 6 carbon atoms, cycloalkyloxy groups having 5 or 6 carbon atoms, aromatic hydrocarbon groups, heterocyclic groups, condensed polycyclic aromatic groups, aryloxy groups or amino groups, $R^5$ and $R^6$, $R^6$ and $R^7$, or $R^7$ and $R^8$ may be bonded together to form a ring, $R^9$ is a hydrogen atom or an alkyl group having 1 to 6 carbon atoms, $m^3$ is an integer of 1 to 20, $n^3$ is an integer of 0 to 20, r is an integer of 1 to 20, and s is an integer of 0 to 20.

6. The toner for developing electrostatic charge image according to claim 3, wherein the charge control agent is an iron complex compound represented by the following general formula (3), (3)

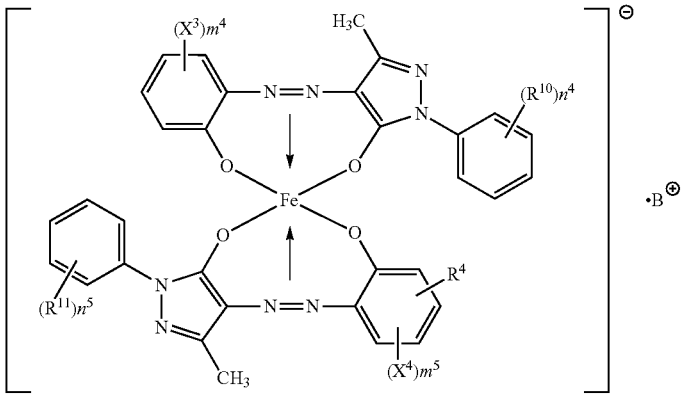

wherein, $X^3$ and $X^4$ may be the same or different, and are fluorine atoms, chlorine atoms, bromine atoms, iodine atoms or alkyl groups having 1 to 8 carbon atoms;

$m^4$ and $m^5$ are integers of 0 to 4;

$R^{10}$ and $R^{11}$ may be the same or different, and are fluorine atoms, chlorine atoms, bromine atoms, iodine atoms, alkyl groups having 1 to 8 carbon atoms, or alkyloxy groups having 1 to 8 carbon atoms;

$n^4$ and $n^5$ are integers of 0 to 5, $B^+$ is a hydrogen ion, sodium ion, potassium ion, ammonium ion or alkylammonium ion, and when $X^3$, $X^4$, $R^{10}$ or $R^{11}$ is present in plural numbers on the same benzene ring, the pluralities of $X^3$, $X^4$, $R^{10}$ or $R^{11}$ may be the same or different respectively.

7. The toner for developing electrostatic charge image according to claim 3, wherein the charge control agent is a cyclic phenol sulfide represented by the following general formula (4), (4)

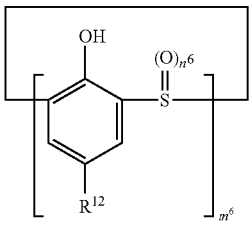

wherein, $R^{12}$ is an alkyl group having 1 to 8 carbon atoms, $m^6$ is an integer of 4 to 9, and $n^6$ is 0, 1 or 2.

8. The toner for developing electrostatic charge image according to claim 3, wherein the charge control agent is a rhodanine compound represented by the following general formula (5), (5)

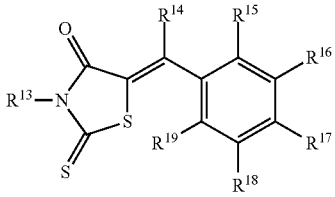

wherein, $R^{13}$ is a hydrogen atom, an alkyl group having 1 to 8 carbon atoms, a cycloalkyl group having 5 to 10 carbon atoms, an aromatic hydrocarbon group, a heterocyclic group or a condensed polycyclic aromatic group, $R^{14}$ is a hydrogen atom, an alkyl group having 1 to 8 carbon atoms, a cycloalkyl group having 5 to 10 carbon atoms, an alkenyl group having 2 to 6 carbon atoms, an alkyloxy group having 1 to 8 carbon atoms, a cycloalkyloxy group having 5 to 10 carbon atoms, an aromatic hydrocarbon group, a heterocyclic group, a condensed polycyclic aromatic group or an aryloxy group; and $R^{15}$ to $R^{19}$ may be the same or different, and are hydrogen atoms, deuterium atoms, fluorine atoms, chlorine atoms, hydroxyl groups, alkyl groups having 1 to 8 carbon atoms, cycloalkyl groups having 5 to 10 carbon atoms, alkenyl groups having 2 to 6 carbon atoms, alkyloxy groups having 1 to 8 carbon atoms, cycloalkyloxy groups having 5 to 10 carbon atoms, aromatic hydrocarbon groups, heterocyclic groups, condensed polycyclic aromatic groups or aryloxy groups, which may be bonded to each other to form a ring.

* * * * *

UNITED STATES PATENT AND TRADEMARK OFFICE

CERTIFICATE OF CORRECTION

PATENT NO. : 9,141,014 B2
APPLICATION NO. : 14/005029
DATED : September 22, 2015
INVENTOR(S) : M. Okubo et al.

It is certified that error appears in the above-identified patent and that said Letters Patent is hereby corrected as shown below:

In the Claims

Column 37, Formula #1, the "NH" on the left should be -- HN --

Column 39, Formula #3, the "R4" on the right should be removed

Signed and Sealed this
Twenty-second Day of March, 2016

Michelle K. Lee

Michelle K. Lee
*Director of the United States Patent and Trademark Office*